US011297878B1

(12) United States Patent
Fujinaga et al.

(10) Patent No.: US 11,297,878 B1
(45) Date of Patent: Apr. 12, 2022

(54) POWER SUPPLY UNIT FOR AEROSOL GENERATION DEVICE

(71) Applicant: Japan Tobacco Inc., Tokyo (JP)

(72) Inventors: Ikuo Fujinaga, Tokyo (JP); Takuma Nakano, Tokyo (JP); Hajime Fujita, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 0 days.

(21) Appl. No.: 17/489,785

(22) Filed: Sep. 30, 2021

(30) Foreign Application Priority Data

Sep. 30, 2020 (JP) ..... JP2020-166298

(51) Int. Cl.

| | |
|---|---|
| ***A24F 13/00*** | (2006.01) |
| ***A24F 40/30*** | (2020.01) |
| ***A24F 40/53*** | (2020.01) |
| ***A24F 40/10*** | (2020.01) |
| ***A24F 40/60*** | (2020.01) |
| ***A24F 40/20*** | (2020.01) |
| ***A24F 40/57*** | (2020.01) |

(52) U.S. Cl.
CPC ..... *A24F 40/30* (2020.01); *A24F 40/10* (2020.01); *A24F 40/20* (2020.01); *A24F 40/53* (2020.01); *A24F 40/57* (2020.01); *A24F 40/60* (2020.01)

(58) Field of Classification Search
CPC ..... A24F 47/00
USPC ..... 131/328–329
See application file for complete search history.

(56) References Cited

U.S. PATENT DOCUMENTS

| | | | |
|---|---|---|---|
| 5,179,966 | A | 1/1993 | Losee et al. |
| 2013/0319440 | A1 | 12/2013 | Capuano |
| 2017/0071251 | A1 | 3/2017 | Goch |
| 2019/0216136 | A1 | 7/2019 | Capuano |
| 2020/0154766 | A1 | 5/2020 | Jeong |

(Continued)

FOREIGN PATENT DOCUMENTS

| | | | |
|---|---|---|---|
| JP | 6030580 | B2 | 11/2016 |
| JP | 2017-511703 | A | 4/2017 |

(Continued)

OTHER PUBLICATIONS

Decision to Grant dated Jan. 12, 2021, received for JP Application 2020-166298, 6 pages including English Translation.

(Continued)

*Primary Examiner* — Phuong K Dinh
(74) *Attorney, Agent, or Firm* — Xsensus LLP

(57) ABSTRACT

A power supply unit for an aerosol generation device, the power supply unit including: a power supply; a first connector electrically connectable to an atomizer capable of atomizing an aerosol source and electrically connected to the power supply; a second connector electrically connectable to a heater capable of heating a flavor source and electrically connected to the power supply; and a processing device. The processing device is configured to generate the aerosol to which the flavor is added by controlling discharge from the power supply to the atomizer and the heater, acquire a remaining amount of the flavor source at a first timing after generation of the aerosol as a first remaining amount, and acquire a second remaining amount, which is a remaining amount of the flavor source at a timing between the first timing and a second timing when next generation of the aerosol starts.

12 Claims, 14 Drawing Sheets

(56) References Cited

U.S. PATENT DOCUMENTS

| | | | | |
|---|---|---|---|---|
| 2020/0352246 | A1* | 11/2020 | Yamada | A24F 40/51 |
| 2021/0169148 | A1 | 6/2021 | Nakano et al. | |
| 2021/0235769 | A1 | 8/2021 | Marubashi et al. | |

FOREIGN PATENT DOCUMENTS

| | | | |
|---|---|---|---|
| JP | 2020-5602 | A | 1/2020 |
| JP | 2020-137528 | A | 9/2020 |
| WO | 2019/017654 | A1 | 1/2019 |
| WO | 2020/039589 | A1 | 2/2020 |
| WO | 2020/084779 | A1 | 4/2020 |

OTHER PUBLICATIONS

European Search Report dated Feb. 4, 2022, in corresponding European Patent Application No. 21199816.6.

* cited by examiner

POWER SUPPLY UNIT FOR AEROSOL GENERATION DEVICE

CROSS-REFERENCE TO RELATED APPLICATIONS

This application claims priority to Japanese Patent Application No. 2020-16629R filed on Sep. 30, 2020, the content of which is incorporated herein by reference.

TECHNICAL FIELD

The present invention relates to a power supply unit for an aerosol generation device.

BACKGROUND ART

JP 6030580 B discloses an electronic cigarette including a heating element, a power supply configured to supply power having a certain voltage to the heating element, a sensor configured to detect an air flow of an inhaling operation, and a processor configured to control the power supply based on an interval of the inhaling operation.

WO 2020/039589, JP 2017-511703 T, and WO 2019/017654 disclose devices that can add a flavor to an aerosol by allowing the aerosol generated by heating a liquid to pass through a flavor source, and allow a user to inhale the aerosol to which the flavor is added.

In order to enhance a commercial value of an aerosol generation device that can generate the aerosol and let the aerosol to be inhaled, it is important for the aerosol generation device to provide a user with an aerosol having a stable flavor for each inhaling.

An object of the present invention is to increase a commercial value of an aerosol generation device.

SUMMARY OF INVENTION

A power supply unit for an aerosol generation device according to an aspect of the present invention includes: a power supply; a first connector electrically connectable to an atomizer capable of atomizing an aerosol source and electrically connected to the power supply; a second connector electrically connectable to a heater capable of heating a flavor source that adds a flavor to an aerosol generated from the aerosol source, and electrically connected to the power supply; and a processing device. The processing device is configured to generate the aerosol to which the flavor is added by controlling discharge from the power supply to the atomizer and the heater, acquire a remaining amount of the flavor source at a first timing after generation of the aerosol to which the flavor is added as a first remaining amount, and acquire a second remaining amount, which is a remaining amount of the flavor source at a timing between the first timing and a second timing when next generation of the aerosol to which the flavor is added starts, as an amount smaller than the first remaining amount.

DESCRIPTION OF EMBODIMENTS

Hereinafter, an aerosol generation device 1, which is an embodiment of an aerosol generation device according to the present invention, will be described with reference to FIGS. 1 to 6.

(Aerosol Generation Device)

Figure 1:
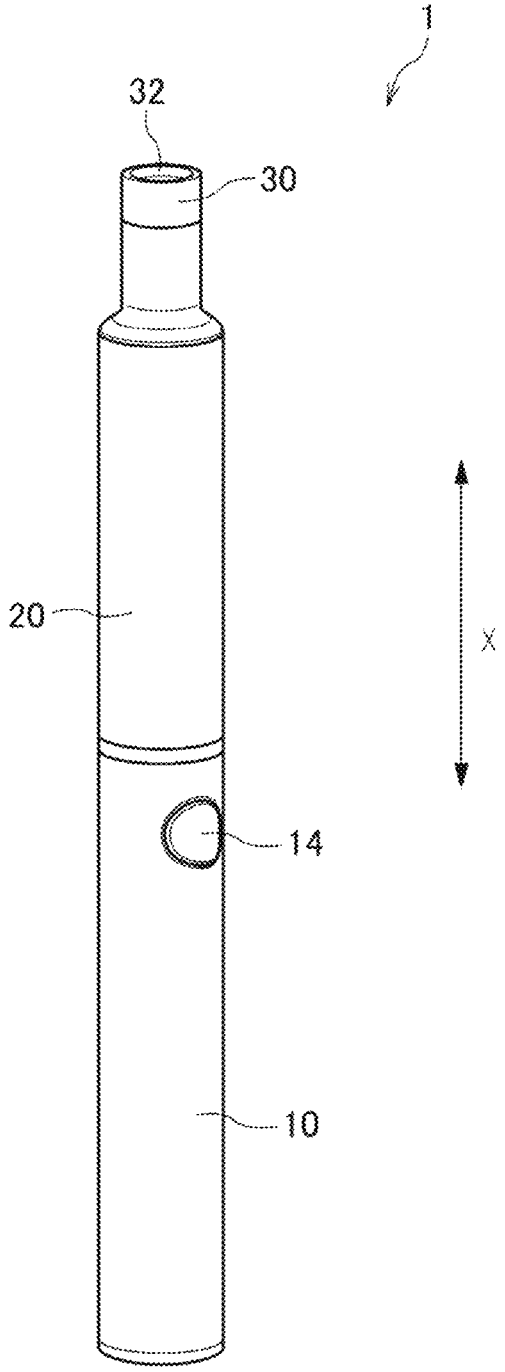
FIG. 1 is a perspective view schematically showing a schematic configuration of an aerosol generation device.
Figure 2:
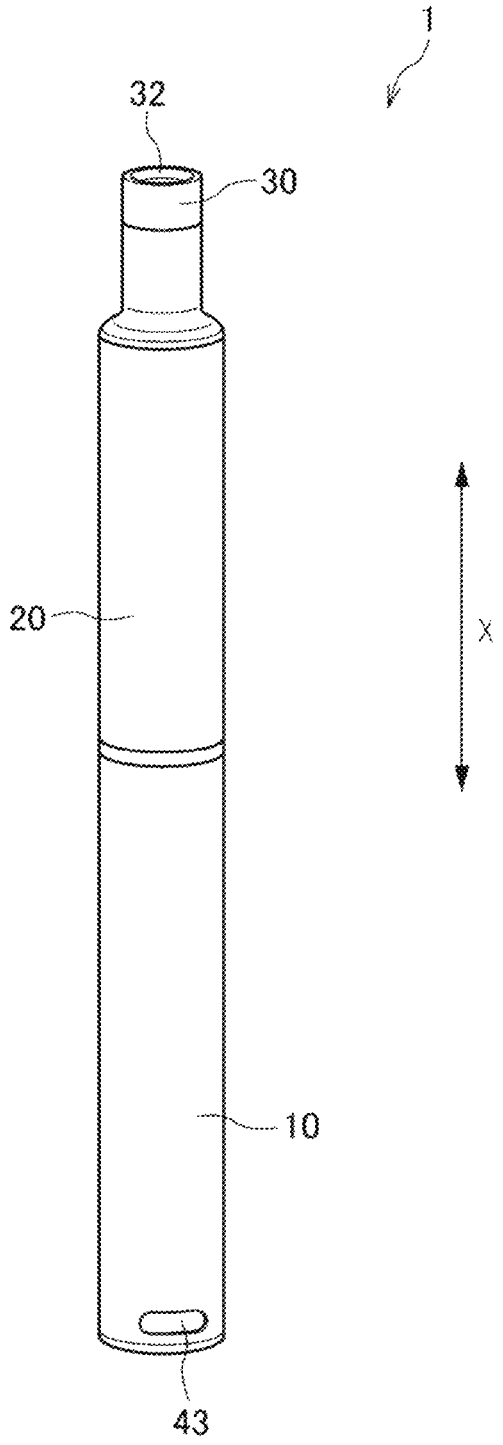
FIG. 2 is another perspective view of the aerosol generation device in FIG. 1.
Figure 3:
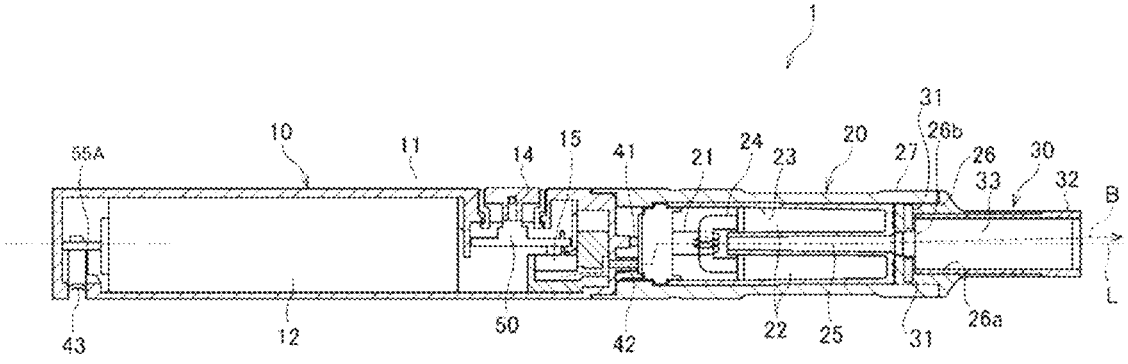
FIG. 3 is a cross-sectional view of the aerosol generation device in FIG. 1.

The aerosol generation device 1 is an instrument that generates an aerosol to which a flavor component is added without burning and allows the aerosol to be inhaled, and has a rod shape that extends along a predetermined direction (hereinafter, referred to as a longitudinal direction X) as shown in FIGS. 1 and 2. In the aerosol generation device 1, a power supply unit 10, a first cartridge 20 and a second cartridge 30 are provided in this order along the longitudinal direction X. The first cartridge 20 is attachable to and detachable from (in other words, replaceable with respect to) the power supply unit 10. The second cartridge 30 is attachable to and detachable from (in other words, replaceable with respect to) the first cartridge 20. As shown in FIG. 3, the first cartridge 20 is provided with a First load 21 and a second load 31. An overall shape of the aerosol generation device 1 is not limited to a shape in which the power supply unit 10, the first cartridge 20 and the second cartridge 30 are arranged in a line as shown in FIG. 1. Any shape such as a substantially box shape can be adopted as long as the first cartridge 20 and the second cartridge 30 are configured to be replaceable with respect to the power supply unit 10. The second cartridge 30 may be attachable to and detachable from (in other words, replaceable with respect to) the power supply unit 10.

(Power Supply Unit)

Figure 4:
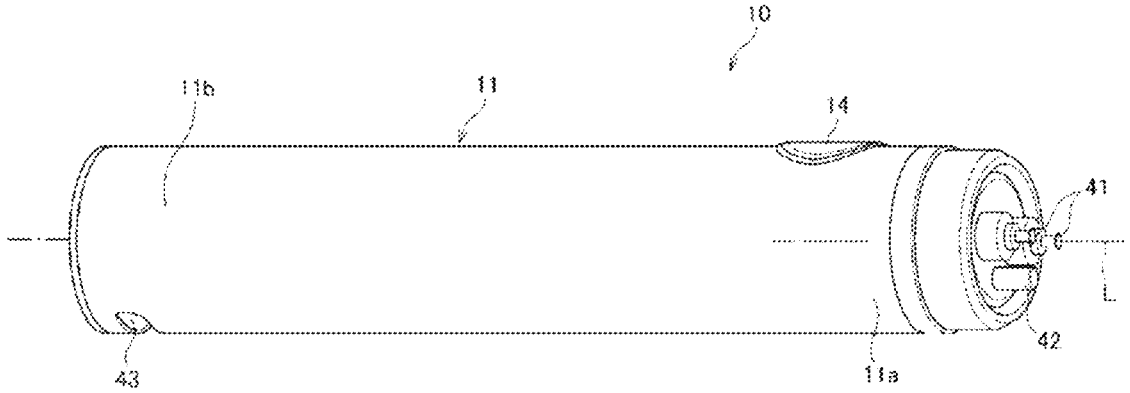
FIG. 4 is a perspective view of a power supply unit in the aerosol generation device in FIG. 1.
Figure 5:
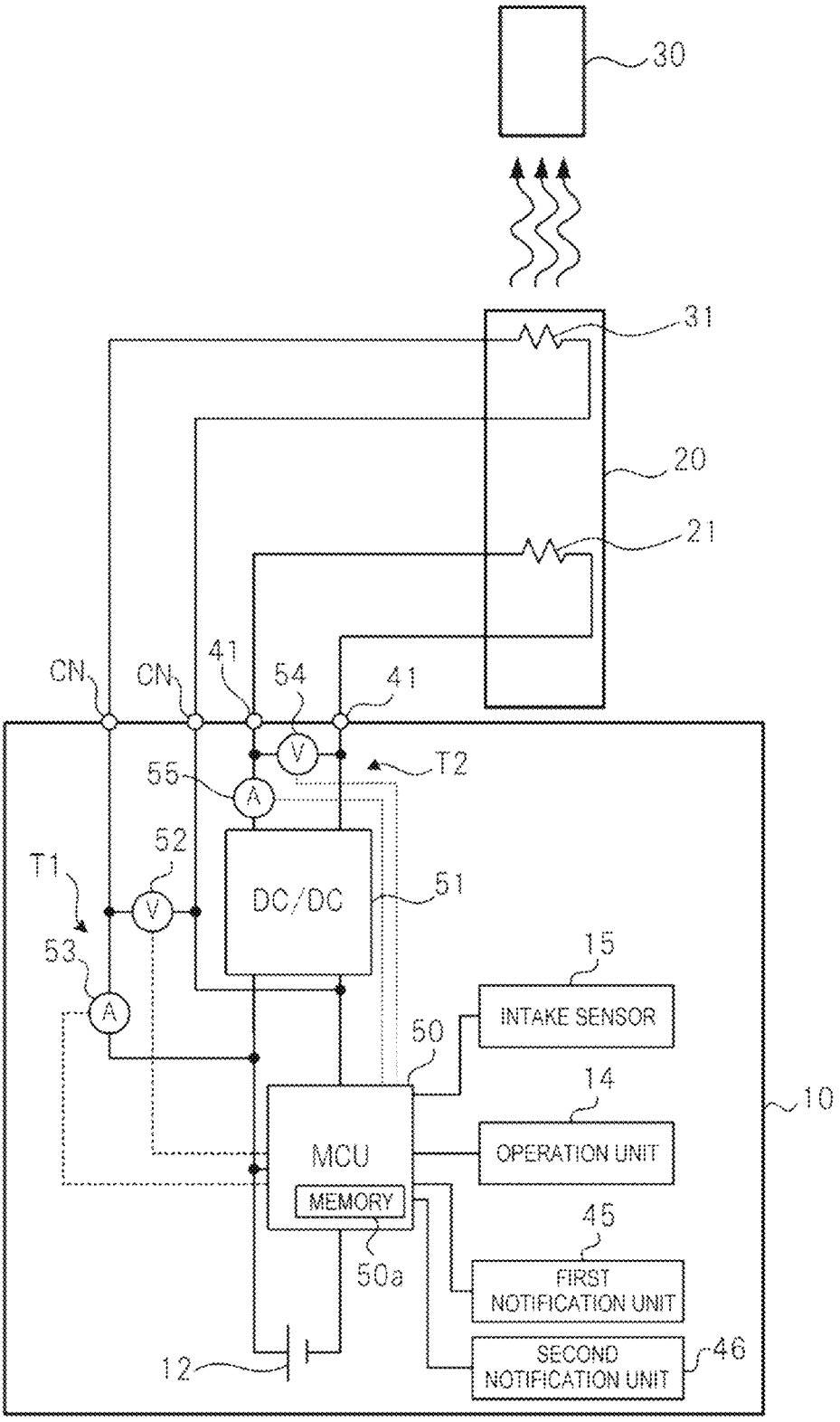
FIG. 5 is a schematic view showing a hardware configuration of the aerosol generation device in FIG. 1.

As shown in FIGS. 3, 4 and 5, the power supply unit 10 accommodates, in a cylindrical power supply unit case 11, a power supply 12, a charging IC 55A, a micro controller unit (MCU) 50, a DC/DC converter 51, an intake sensor 15, a temperature detection element T1 including a voltage sensor 52 and a current sensor 53, a temperature detection element T2 including a voltage sensor 54 and a current sensor 55, a first notification unit 45, and a second notification unit 46.

The power supply 12 is a rechargeable secondary battery, an electric double layer capacitor or the like, and is preferably a lithium ion secondary battery. An electrolyte of the power supply 12 may be constituted by one of a gel-like electrolyte, an electrolytic solution, a solid electrolyte, an ionic liquid, or a combination thereof.

As shown in FIG. 5, the MCU 50 is connected to various sensor devices such as the intake sensor 15, the voltage sensor 52, the current sensor 53, the voltage sensor 54 and the current sensor 55, the DC/DC converter 51, an operation unit 14, the first notification unit 45, and the second notification unit 46, and performs various types of control of the aerosol generation device 1.

Specifically, the MCU 50 mainly includes a processor, and further includes a memory 50*a* formed of a storage medium such as a random access memory (RAM) required for an operation of the processor and a read only memory (ROM) that stores various types of information. Specifically, the processor in the present specification is an electric circuit in which circuit elements such as semiconductor elements are combined.

As shown in FIG. 4, a discharging terminal 41 constituting a first connector are provided on a top portion 11*a* positioned on one end side of the power supply unit case 11 in the longitudinal direction X (a first cartridge 20 side). The discharging terminal 41 is provided so as to protrude from an upper surface of the top portion 11*a* toward the first cartridge 20, and can be electrically connected to each of the first load 21 and the second load 31 of the first cartridge 20. Although not shown in FIG. 4, the top portion 11*a* is provided with a connector CN constituting a second connector (see FIGS. 5 and 6). The discharging terminal 41 is electrically connected to the power supply 12. The discharging terminal 41 is electrically connected to the first load 21 in a state where the first cartridge 20 is attached to the power supply unit 10. The connector CN is electrically connected to the power supply 12. The connector CN is electrically connected to the second load 31 in a state where the first cartridge 20 is attached to the power supply unit 10. In the aerosol generation device 1 shown in FIGS. 4 to 6, the first load 21 and the second load 31 are provided in the first cartridge 20. Alternatively, the second load 31 may be provided in the second cartridge 30, and the first load 21 and the second load 31 may be provided in the power supply unit 10. In either case, the discharging terminal 41 constituting the first connector and the connector CN constituting the second connector are provided in the power supply unit 10.

On the upper surface of the top portion 11*a*, an air supply unit 42 that supplies air to the first load 21 of the first cartridge 20 is provided in vicinity of the discharging terminal 41.

A charging terminal 43 that can be electrically connected to an external power supply (not shown) is provided in a bottom portion 11*b* positioned on the other end side of the power supply unit case 11 in the longitudinal direction X (a side opposite to the first cartridge 20). The charging terminal 43 is provided in a side surface of the bottom portion 11*b*, and can be connected to, for example, a universal serial bus (USB) terminal, a microUSB terminal or the like.

The charging terminal 43 may be a power reception unit that can receive power transmitted from the external power supply in a wireless manner. In such a case, the charging terminal 43 (the power reception unit) may be formed of a power reception coil. A wireless power transfer method may be an electromagnetic induction type, a magnetic resonance type, or a combination of the electromagnetic induction type and the magnetic resonance type. The charging terminal 43 may be a power reception unit that can receive power transmitted from the external power supply in a contactless manner. As another example, the charging terminal 43 can be connected to a USB terminal or a micro USB terminal, and may include the power reception unit described above.

The power supply unit case 11 is provided with the operation unit 14 that can be operated by a user in a side surface of the top portion 11*a* so as to face a side opposite to the charging terminal 43. More specifically, the operation unit 14 and the charging terminal 43 have a point-symmetrical relationship with respect to an intersection between a straight line connecting the operation unit 14 and the charging terminal 43 and a center line of the power supply unit 10 in the longitudinal direction X. The operation unit 14 includes a button-type switch, a touch panel or the like. When a predetermined activation operation is performed by the operation unit 14 in a state where the power supply unit 10 is in a power-off state, the operation unit 14 outputs an activation command of the power supply unit 10 to the MCU 50. When the MCU 50 acquires the activation command, the MCU 50 activates the power supply unit 10.

As shown in FIG. 3, the intake sensor 15 that detects a puff (inhaling) operation is provided in vicinity of the operation unit 14. The power supply unit case 11 is provided with an air intake port (not shown) that takes outside air into the power supply unit case 11. The air intake port may be provided around the operation unit 14 or may be provided around the charging terminal 43.

The intake sensor 15 is configured to output a value of a change in pressure (internal pressure) in the power supply unit 10 due to inhaling of the user through an inhale port 32 described later. The intake sensor 15 is, for example, a pressure sensor that outputs an output value (for example, a voltage value or a current value) corresponding to the internal pressure that changes according to a flow rate of air inhaled from the air intake port toward the inhale port 32 (that is, the puff operation of the user). The intake sensor 15 may output an analog value, or may output a digital value converted from the analog value.

In order to compensate for a pressure to be detected, the intake sensor 15 may include a temperature sensor that detects a temperature of an environment where the power supply unit 10 is placed (an outside air temperature). The intake sensor 15 may include a condenser microphone or the like instead of the pressure sensor.

When the puff operation is performed and the output value of the intake sensor 15 is equal to or greater than an output threshold value, the MCU 50 determines that an aerosol generation request (an atomization command of an aerosol source 22 described later) is made, and thereafter, when the output value of the intake sensor 15 falls below the output threshold value, the MCU 50 determines that the aerosol generation request ends. In the aerosol generation device 1, for a purpose of preventing overheating of the first load 21 or the like, when a period during which the aerosol generation request is made reaches an upper limit time $t_{upper}$ (for example, 2.4 seconds), it is determined that the aerosol generation request ends regardless of the output value of the intake sensor 15.

Instead of the intake sensor 15, the aerosol generation request may be detected based on an operation of the operation unit 14. For example, when the user performs a predetermined operation on the operation unit 14 in order to start inhaling of an aerosol, the operation unit 14 may output a signal indicating the aerosol generation request to the MCU 50.

The charging IC 55A is disposed close to the charging terminal 43, and controls charging of power input from the charging terminal 43 to the power supply 12. The charging IC 55A may be disposed in vicinity of the MCU 50.

(First Cartridge)

As shown in FIG. 3, the first cartridge 20 includes, inside a cylindrical cartridge case 27, a reservoir 23 constituting a storage portion that stores the aerosol source 22, the first load 21 constituting an atomizer that atomizes the aerosol source 22 to generate the aerosol, a wick 24 that draws the aerosol source 22 from the reservoir 23 to a position of the first load 21, an aerosol flow path 25 constituting a cooling passage that sets a particle size of the aerosol generated by atomization of the aerosol source 22 to a size suitable for inhaling, an end cap 26 that accommodates a part of the second cartridge 30, and the second load 31 provided on the end cap 26 for heating the second cartridge 30.

The reservoir 23 is partitioned and formed so as to surround a periphery of the aerosol flow path 25, and stores the aerosol source 22. A porous body such as a resin web or cotton may be accommodated in the reservoir 23, and the aerosol source 22 may be impregnated in the porous body. The reservoir 23 may only store the aerosol source 22 without accommodating the porous body such as the resin web or cotton. The aerosol source 22 contains a liquid such as glycerin, propylene glycol or water.

The wick 24 is a liquid holding member that draws the aerosol source 22 from the reservoir 23 to the position of the first load 21 by using a capillary phenomenon. The wick 24 constitutes a holding portion that holds the aerosol source 22 supplied from the reservoir 23 at the position where the aerosol source 22 can be atomized by the first load 21. The wick 24 is made of, for example, glass fiber or porous ceramic.

The aerosol source 22 included in the first cartridge 20 is held by each of the reservoir 23 and the wick 24, but in the following, a reservoir remaining amount $W_{reservoir}$, which is a remaining amount of the aerosol source 22 stored in the reservoir 23, is treated as the remaining amount of the aerosol source 22 included in the first cartridge 20. The reservoir remaining amount $W_{reservoir}$ is 100% when the first cartridge 20 is new, and decreases as the aerosol is generated (the aerosol source 22 is atomized). The reservoir remaining amount $W_{reservoir}$ is calculated by the MCU 50 and stored in the memory 50*a* of the MCU 50. Hereinafter, the reservoir remaining amount $W_{reservoir}$ may be simply referred to as a reservoir remaining amount.

The first load 21 heats the aerosol source 22 by power supplied from the power supply 12 via the discharging terminal 41 without burning, thereby atomizing the aerosol source 22. In principle, as the power supplied from the power supply 12 to the first load 21 increases, an amount of the aerosol source to be atomized increases. The first load 21 is formed of an electric heating wire (a coil) wound at a predetermined pitch.

The first load 21 may be any element that can atomize the aerosol source 22 to generate the aerosol by heating the aerosol source 22. The first load 21 is, for example, a heat generation element. Examples of the heat generation element include a heat generation resistor, a ceramic heater and an induction heating type heater.

The first load 21 has a correlation between temperature and electric resistance. As the first load 21, for example, a load having positive temperature coefficient (PTC) characteristics in which an electric resistance value increases as a temperature increases is used.

The aerosol flow path 25 is provided on a center line L of the power supply unit 10 on a downstream side of the first load 21. The end cap 26 includes a cartridge accommodating portion 26*a* that accommodates a part of the second cartridge 30, and a communication path 26*b* that allows the aerosol flow path 25 and the cartridge accommodating portion 26*a* to communicate with each other.

The second load 31 is embedded in the cartridge accommodating portion 26*a*. The second load 31 heats the second cartridge 30 (more specifically, a flavor source 33 included in the second cartridge 30) accommodated in the cartridge accommodating portion 26*a* by the power supplied from the power supply 12 via the discharging terminal 41. The second load 31 is formed of, for example, an electric heating wire (a coil) wound at a predetermined pitch.

The second load 31 may be any element that can heat the second cartridge 30. The second load 31 is, for example, a heat generation element. Examples of the heat generation element include a heat generation resistor, a ceramic heater and an induction heating type heater.

The second load 31 has a correlation between temperature and electric resistance. As the second load 31, for example, a load having the PTC characteristics is used.

(Second Cartridge)

The second cartridge 30 stores the flavor source 33. When the second cartridge 30 is heated by the second load 31, the flavor source 33 is heated. The second cartridge 30 is detachably accommodated in the cartridge accommodating portion 26*a* provided in the end cap 26 of the first cartridge 20. In the second cartridge 30, an end portion on a side opposite to the first cartridge 20 side serves as the inhale port 32 of the user. The inhale port 32 is not limited to a case where the inhale port 32 is integrally formed with the second cartridge 30, and may be configured to be detachable from the second cartridge 30. The inhale port 32 can be kept hygienic by configuring the inhale port 32 separately from the power supply unit 10 and the first cartridge 20 in this way.

The second cartridge 30 adds a flavor component to the aerosol by allowing the aerosol generated by atomization of the aerosol source 22 by the first load 21 to pass through the flavor source 33. As a raw material piece constituting the flavor source 33, it is possible to use chopped tobacco or a molded body obtained by molding a tobacco raw material into a granular shape. The flavor source 33 may be formed of a plant other than tobacco (for example, mint, Chinese herb or herb). A fragrance such as menthol may be added to the flavor source 33.

In the aerosol generation device 1, the aerosol source 22 and the flavor source 33 can generate the aerosol to which the flavor component is added. That is, the aerosol source 22 and the flavor source 33 constitute an aerosol generation source that generates the aerosol.

The aerosol generation source in the aerosol generation device 1 is a portion that is replaced and used by the user. The portion is provided to the user, for example, as a set of one first cartridge 20 and one or more (for example, five) second cartridges 30. The first cartridge 20 and the second cartridge 30 may be integrated into one cartridge.

In the aerosol generation device 1 configured in this way, as indicated by an arrow B in FIG. 3, air that flows in from the intake port (not shown) provided in the power supply unit case 11 passes through vicinity of the first load 21 of the first cartridge 20 from the air supply unit 42. The first load 21 atomizes the aerosol source 22 drawn from the reservoir 23 by the wick 24. The aerosol generated by atomization flows through the aerosol flow path 25 together with the air that flows in from the intake port, and is supplied to the second cartridge 30 via the communication path 26*b*. The aerosol supplied to the second cartridge 30 passes through the flavor source 33 to be added with the flavor component, and is then supplied to the inhale port 32.

The aerosol generation device 1 is also provided with the first notification unit 45 and the second notification unit 46 that notify the user of various types of information (see FIG. 5). The first notification unit 45 is for performing a notification that acts on tactile sense of the user, and is formed of a vibration element such as a vibrator. The second notification unit 46 is for performing a notification that acts on visual sense of the user, and is formed of a light emitting element such as a light emitting diode (LED). As the notification unit that notifies various types of information, a sound output element may be further provided to perform a notification that acts on auditory sense of the user. The first notification unit 45 and the second notification unit 46 may be provided in any one of the power supply unit 10, the first cartridge 20 and the second cartridge 30, but are preferably provided in the power supply unit 10. For example, a configuration in which a periphery of the operation unit 14 has light-transmissive properties and light is emitted by a light emitting element such as an LED is employed. One of the first notification unit 45 and the second notification unit 46 may be omitted.

(Details of Power Supply Unit)

As shown in FIG. 5, the DC/DC converter 51 is connected between the first load 21 and the power supply 12 in a state where the first cartridge 20 is attached to the power supply unit 10. The MCU 50 is connected between the DC/DC converter 51 and the power supply 12. The second load 31 is connected between the MCU 50 and the DC/DC converter 51 in a state where the first cartridge 20 is attached to the power supply unit 10. In this way, in the power supply unit 10, a series circuit of the DC/DC converter 51 and the first load 21, and the second load 31 are connected in parallel to the power supply 12 in a state where the first cartridge 20 is attached.

The DC/DC converter 51 is a booster circuit that can boost an input voltage, and is configured to supply a voltage obtained by boosting the input voltage or the input voltage to the first load 21. Since the power supplied to the first load 21 can be adjusted by the DC/DC converter 51, an amount of the aerosol source 22 atomized by the first load 21 can be controlled. As the DC/DC converter 51, for example, a switching regulator that converts the input voltage into a desired output voltage by controlling an on/off time of a switching element while monitoring the output voltage can be used. When the switching regulator is used as the DC/DC converter 51, the input voltage can be output directly without being boosted by controlling the switching element.

The processor of the MCU 50 is configured to acquire a temperature of the flavor source 33 and a temperature of the second load 31 in order to control discharge to the second load 31. The processor of the MCU 50 is preferably configured to acquire the temperature of the first load 21. The temperature of the first load 21 can be used to prevent overheating of the first load 21 or the aerosol source 22, and to highly control the amount of the aerosol source 22 atomized by the first load 21.

The voltage sensor 52 measures and outputs a value of a voltage applied to the second load 31. The current sensor 53 measures and outputs a value of a current that flows through the second load 31. An output of the voltage sensor 52 and an output of the current sensor 53 are input to the MCU 50. The processor of the MCU 50 acquires a resistance value of the second load 31 based on the output of the voltage sensor 52 and the output of the current sensor 53, and acquires the temperature of the second load 31 corresponding to the resistance value. The temperature of the second load 31 does not exactly coincide with the temperature of the flavor source 33 heated by the second load 31, but can be regarded as substantially the same as the temperature of the flavor source 33.

If a constant current flows through the second load 31 when the resistance value of the second load 31 is acquired, the current sensor 53 is unnecessary in the temperature detection element T1. Similarly, if a constant voltage is applied to the second load 31 when the resistance value of the second load 31 is acquired, the voltage sensor 52 is unnecessary in the temperature detection element T1.

Figure 6:
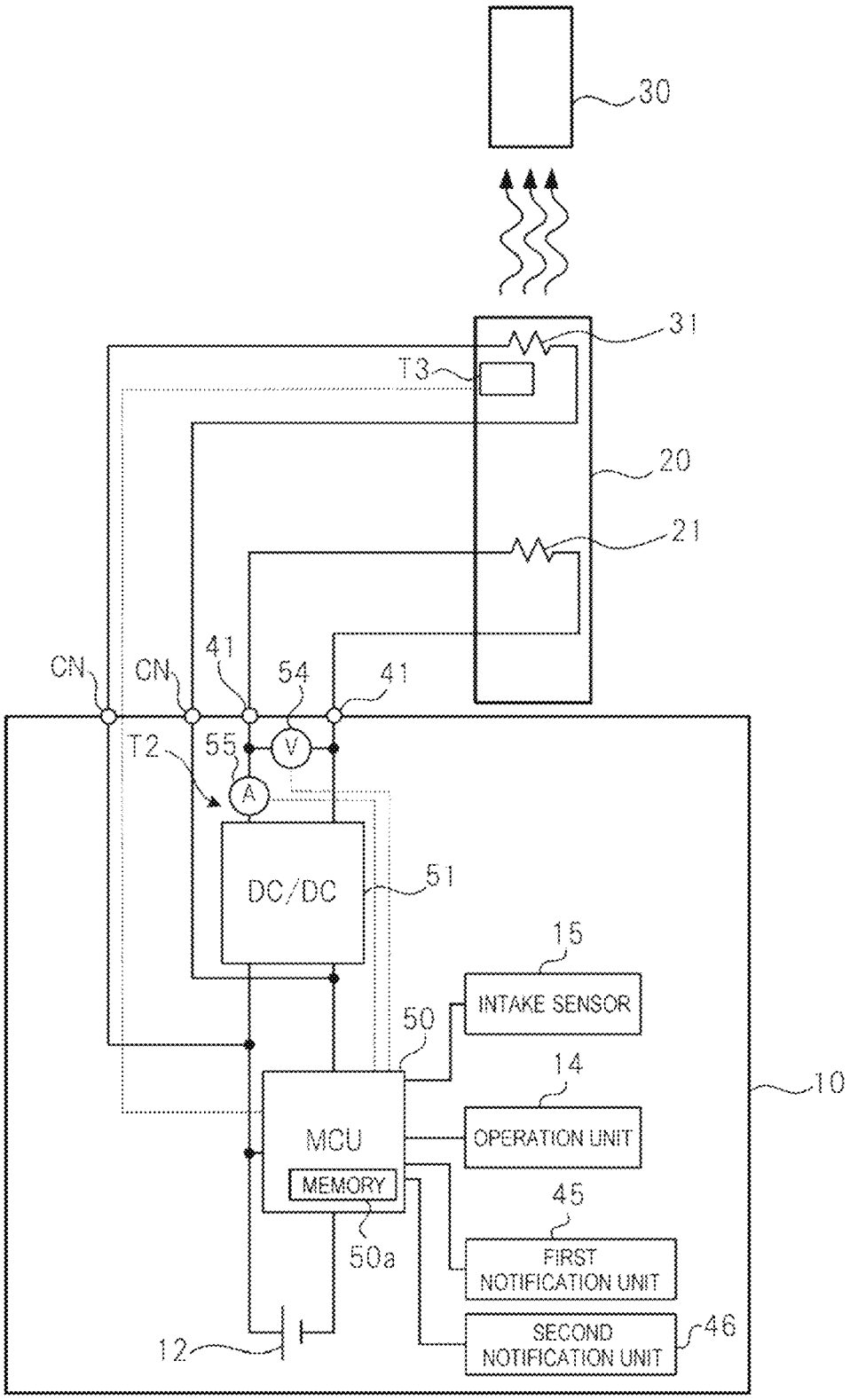
FIG. 6 is a schematic view showing a modification of the hardware configuration of the aerosol generation device in FIG. 1.

As shown in FIG. 6, instead of the temperature detection element T1, a temperature detection element T3 that detects a temperature of the second cartridge 30 or the second load 31 may be provided in the first cartridge 20. The temperature detection element T3 is formed of, for example, a thermistor disposed in vicinity of the second cartridge 30 or the second load 31. In a configuration shown in FIG. 6, the processor of the MCU 50 acquires the temperature of the second load 31 or the temperature of the second cartridge 30, in other words, a temperature of the flavor source 33, based on an output of the temperature detection element T3.

As shown in FIG. 6, by acquiring the temperature of the flavor source 33 using the temperature detection element T3, the temperature of the flavor source 33 can be acquired more accurately than by acquiring the temperature of the flavor source 33 using the temperature detection element T1 in FIG. 5. The temperature detection element T3 may be mounted on the second cartridge 30. According to the configuration shown in FIG. 6 in which the temperature detection element T3 is mounted on the first cartridge 20, a manufacturing cost of the second cartridge 30 having the highest replacement frequency in the aerosol generation device 1 can be reduced.

As shown in FIG. 5, when the temperature of the flavor source 33 is acquired using the temperature detection element T1, the temperature detection element T1 can be provided in the power supply unit 10 having the lowest replacement frequency in the aerosol generation device 1. Therefore, a manufacturing cost of the first cartridge 20 and the second cartridge 30 can be reduced.

The voltage sensor 54 measures and outputs a value of a voltage applied to the first load 21. The current sensor 55 measures and outputs a value of a current that flows through the first load 21. An output of the voltage sensor 54 and an output of the current sensor 55 are input to the MCU 50. The processor of the MCU 50 acquires a resistance value of the first load 21 based on the output of the voltage sensor 54 and the output of the current sensor 55, and acquires the temperature of the first load 21 corresponding to the resistance value. If a constant current flows through the first load 21 when the resistance value of the first load 21 is acquired, the current sensor 55 is unnecessary in the temperature detection element T2. Similarly, if a constant voltage is applied to the first load 21 when the resistance value of the first load 21 is acquired, the voltage sensor 54 is unnecessary in the temperature detection element T2.

(MCU)

Next, functions of the MCU 50 will be described. The MCU 50 includes a temperature detection unit, a power control unit and a notification control unit as functional blocks realized by the processor executing programs stored in the ROM.

The temperature detection unit acquires the temperature of the flavor source 33 based on an output of the temperature detection element T1 (or the temperature detection element T3). The temperature detection unit acquires the temperature of the first load 21 based on an output of the temperature detection element T2.

The notification control unit controls the first notification unit 45 and the second notification unit 46 to notify various types of information. For example, the notification control unit controls at least one of the first notification unit 45 and the second notification unit 46 to perform a notification for prompting replacement of the second cartridge 30 in response to detection of a replacement timing of the second cartridge 30. The notification control unit is not limited to performing of the notification for prompting the replacement of the second cartridge 30, and may cause a notification for prompting replacement of the first cartridge 20, a notification for prompting replacement of the power supply 12, a notification for prompting charging of the power supply 12, or the like to be performed.

The power control unit controls discharge from the power supply 12 to at least the first load 21 among the first load 21 and the second load 31 (discharge required for heating the load) according to the signal indicating the aerosol generation request output from the intake sensor 15. That is, the power control unit performs at least first discharge among the first discharge from the power supply 12 to the first load 21 for atomizing the aerosol source 22 and second discharge from the power supply 12 to the second load 31 for heating the flavor source 33.

In this way, in the aerosol generation device 1, the flavor source 33 can be heated by the discharge to the second load 31. In order to increase an amount of the flavor component added to the aerosol, it is experimentally known that it is effective to increase an amount of the aerosol generated from the aerosol source 22 and to increase the temperature of the flavor source 33.

Therefore, the power control unit controls the discharge for heating from the power supply 12 to the first load 21 and the second load 31 such that a unit flavor amount (a flavor component amount $W_{flavor}$ described below), which is the amount of the flavor component added to the aerosol generated for each aerosol generation request, converges to a target amount, based on information on the temperature of the flavor source 33. The target amount is a value that is appropriately determined. For example, a target range of the unit flavor amount may be appropriately determined, and a median value in the target range may be determined as the target amount. Accordingly, the unit flavor amount (the flavor component amount $W_{flavor}$) converges to the target amount, whereby the unit flavor amount can converge to the target range having a certain width. Weight may be used as a unit of the unit flavor amount, the flavor component amount $W_{flavor}$, and the target amount.

The power control unit controls the discharge for heating from the power supply 12 to the second load 31 such that the temperature of the flavor source 33 converges to a target temperature (a target temperature $T_{cap_target}$ described below), based on the output of the temperature detection element T1 (or the temperature detection element T3) that outputs the information on the temperature of the flavor source 33.

(Various Parameters Used for Aerosol Generation)

Before proceeding to description of a specific operation of the MCU 50, various parameters and the like used for discharge control for aerosol generation will be described below.

A weight [mg] of the aerosol generated in the first cartridge 20 by one inhaling operation of the user is referred to as an aerosol weight $W_{aerosol}$. The power required to be supplied to the first load 21 for generating the aerosol is referred to as atomization power $P_{liquid}$. Assuming that the aerosol source 22 is sufficiently present, the aerosol weight $W_{aerosol}$ is proportional to the atomization power $P_{liquid}$ and a supply time $t_{sense}$ of the atomization power $P_{liquid}$ to the first load 21 (in other words, an energization time of the first load 21 or a puff time). Therefore, the aerosol weight $W_{aerosol}$ can be modeled by the following Equation (1). In Equation (1), α is a coefficient obtained experimentally. An upper limit value of the supply time $t_{sense}$ is the above-described upper limit time $t_{upper}$. In addition, the following Equation (1) may be replaced with Equation (1A). In Equation (1A), an intercept b having a positive value is introduced into Equation (1). This is a term that can be freely introduced in consideration of a fact that a part of the atomization power $P_{liquid}$ is used for a rise in the temperature of the aerosol source 22, which occurs before atomization in the aerosol source 22. The intercept b can also be obtained experimentally.

$$W_{aerosol}=\alpha\times P_{liquid}\times t_{sense} \tag{1}$$

$$W_{aerosol}=\alpha\times P_{liquid}\times t_{sense}-b \tag{1A}$$

The weight [mg] of the flavor component contained in the flavor source 33 in a state where the inhaling is performed $n_{puff}$ times ($n_{puff}$ is a natural number of 0 or greater) is described as a flavor component remaining amount $W_{capsule}$ ($n_{puff}$). The flavor component remaining amount ($W_{capsule}$ ($n_{puff}$=0)) contained in the flavor source 33 of the second cartridge 30 in a new product state is also referred to as $W_{initial}$. The information on the temperature of the flavor source 33 is described as a capsule temperature parameter $T_{capsule}$. The weight [mg] of the flavor component added to the aerosol passing through the flavor source 33 by one inhaling operation of the user is described as a flavor component amount $W_{flavor}$. The information on the temperature of the flavor source 33 is, for example, the temperature of the flavor source 33 or the temperature of the second load 31 acquired based on the output of the temperature detection element T1 (or the temperature detection element T3). Hereinafter, the flavor component remaining amount $W_{capsule}$ ($n_{puff}$) may be simply referred to as the flavor component remaining amount.

It is experimentally known that the flavor component amount $W_{flavor}$ depends on the flavor component remaining amount $W_{capsule}$ ($n_{puff}$), the capsule temperature parameter $T_{capsule}$ and the aerosol weight $W_{aerosol}$. Therefore, the flavor component amount $W_{flavor}$ can be modeled by the following Equation (2).

$$W_{flavor}=\beta\delta\{W_{capsule}(n_{puff})\times T_{capsule}\}\times\gamma\times W_{aerosol} \tag{2}$$

Each time the inhaling is performed, the flavor component remaining amount $W_{capsule}$ ($n_{puff}$) decreases by the flavor component amount $W_{flavor}$. Therefore, the flavor component remaining amount $W_{capsule}$ ($n_{puff}$) when $n_{puff}$ is 1 or greater, that is, the flavor component remaining amount after one or more times of inhaling can be modeled by the following Equation (3).

$$W_{capsule}(n_{puff})=W_{initial}-\delta\cdot\Sigma_{i=1}^{n_{puff}}W_{flavor}(i) \tag{3}$$

β in Equation (2) is a coefficient indicating a ratio of how much of the flavor component contained in the flavor source 33 is added to the aerosol in one time of inhaling, and is experimentally obtained. γ in Equation (2) and δ in Equation (3) are experimentally obtained coefficients. While the capsule temperature parameter $T_{capsule}$ and the flavor component remaining amount $W_{capsule}(n_{puff})$ may vary during one time of inhaling, γ and δ are introduced in this model in order to handle these as constant values.

(Operation of Aerosol Generation Device)

A general flow of an operation of the aerosol generation device 1 is as follows. When the aerosol generation device 1 is activated (powered ON) by an operation of the operation unit 14 or the like, a target temperature of the flavor source 33 is set. Then, control on discharge to the second load 31 is performed such that a temperature of the flavor source 33 or a temperature of the second load 31 converges to the target temperature, and heating (preheating) of the flavor source 33 is started. When the target temperature is set, atomization power required to be supplied to the first load 21 in order to achieve the target flavor component amount $W_{flavor}$ is determined based on the target temperature and the flavor component remaining amount at that time point. When an aerosol generation request is made after a start of the preheating, the preheating of the flavor source 33 is stopped, and at least the determined atomization power is supplied to the first load 21 to generate an aerosol. The heating of the flavor source 33 may be continued during the aerosol generation period. When the aerosol generation request ends, supply of the atomization power to the first load 21 is stopped. Thereafter, the flavor component remaining amount is updated, the target temperature of the flavor source 33 is reset, and the above operation is repeated. The supply of the atomization power to the first load 21 may be stopped when a predetermined time has elapsed since a start of the supply of the atomization power to the first load 21 even if the aerosol generation request is continued. Also in this case, the flavor component remaining amount is updated, the target temperature of the flavor source 33 is reset, and the above operation is repeated.

Figure 7:
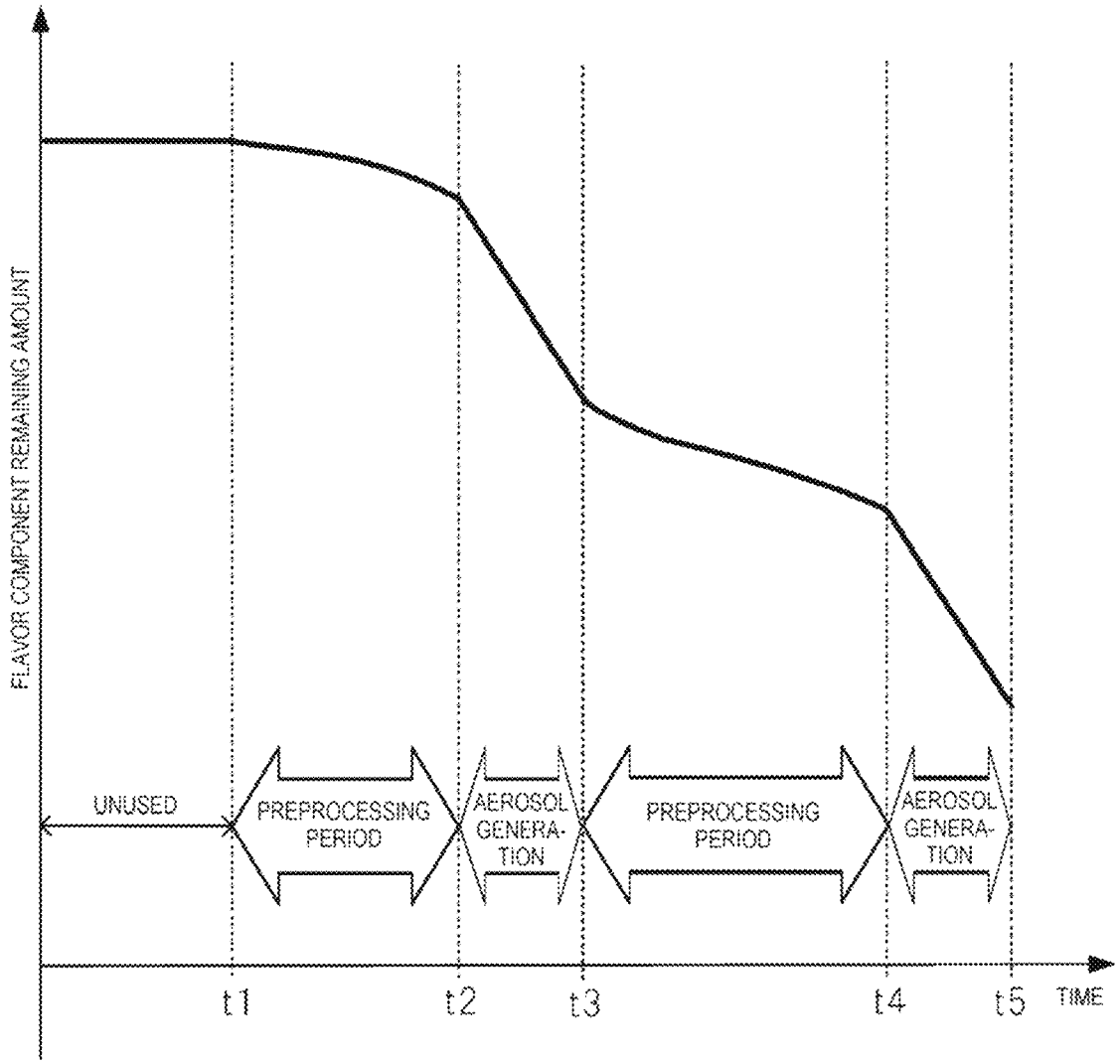
FIG. 7 is a schematic view showing a change in a flavor component remaining amount during an operation of the aerosol generation device 1.
Figure 8:
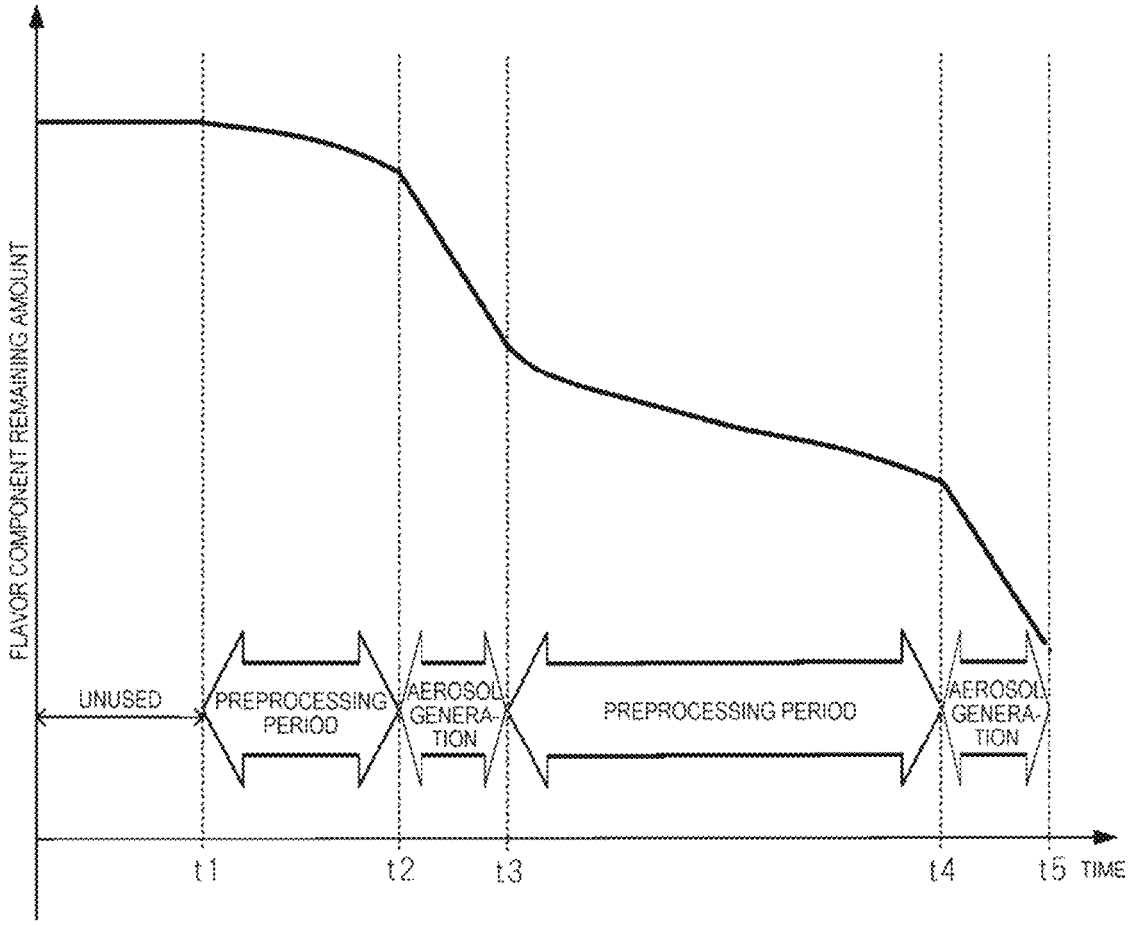
FIG. 8 is a schematic view showing a change in the flavor component remaining amount during the operation of the aerosol generation device 1.

FIGS. 7 and 8 are schematic views showing changes in the flavor component remaining amount during the operation of the aerosol generation device 1. FIGS. 7 and 8 show examples of the change in the flavor component remaining amount from time t1 to time t5. A period up to the time t1 is a period during which the aerosol generation device 1 is powered OFF. A period between the time t1 and the time t2 and a period between the time 13 and the time t4 are each a preprocessing period during which preprocessing for aerosol generation is performed. In the preprocessing period, as described above, the updating of the flavor component remaining amount, the setting of the target temperature, the determination of the atomization power, the preheating of the flavor source 33 and the like are performed. A difference between FIG. 7 and FIG. 8 is that a length of time between the time t3 and the time t4 is different. The length of the preprocessing period can be changed by an operation of the user. A period between the time t2 and the time t3 and a period between the time t4 and the time t5 are each an aerosol generation period. A length of the aerosol generation period can be changed by an operation of the user.

A flavor component contained in the flavor source 33 is added to the aerosol when the aerosol passes through the flavor source 33. Therefore, the flavor component remaining amount decreases during the aerosol generation period. However, a decrease in the flavor component remaining amount is caused by volatilization of the flavor component in addition to addition of the flavor component to the aerosol.

For example, when the flavor source 33 is heated, the volatilization of the flavor component occurs. Even before aerosol generation is completed and the heating of the flavor source 33 is started, the volatilization of the flavor component is likely to occur due to passage of the aerosol, an increase in the temperature of the flavor source 33 due to the heating performed by the second load 31, a flow of air after the inhaling is completed, and the like. In this state, the higher an outside air temperature is, the more likely a state where the temperature of the flavor source 33 is high is maintained, so that a volatilization amount of the flavor component is increased. In this state, as the temperature (or the target temperature) of the flavor source 33 at an end of the aerosol generation is higher, the volatilization of the flavor component is more likely to occur, and thus the volatilization amount of the flavor component increases. As can be seen from a comparison between FIG. 7 and FIG. 8, the volatilization amount of the flavor component increases as duration of a state where the volatilization is likely to occur increases. In addition, as the flavor component remaining amount is larger, a larger amount of the flavor component that can be volatilized is present in the flavor source 33. Therefore, in the state where the volatilization is likely to occur in a period other than the aerosol generation period, the volatilization amount of the flavor component increases as the flavor component remaining amount increases.

In this way, in a period during which the aerosol is not generated (between the time t1 and the time t2, and between the time t3 and the time t4), the flavor component remaining amount can be reduced by the volatilization.

The volatilization amount of the flavor component increases as a cumulative amount of the aerosol that has passed through the flavor source 33 increases. This is because the aerosol that has passed through the flavor source 33 temporarily shifts the flavor source 33 to the inhale port 32 or a filter provided in vicinity of the inhale port 32, and then the flavor source 33 volatilizes.

In the above-described Equation (3) for deriving the flavor component remaining amount, such volatilization of the flavor component is not taken into consideration. Therefore, in the aerosol generation device 1, the flavor component remaining amount is corrected in consideration of the volatilization of the flavor component. Hereinafter, a specific example of the operation of the aerosol generation device 1 will be described.

Figure 9:
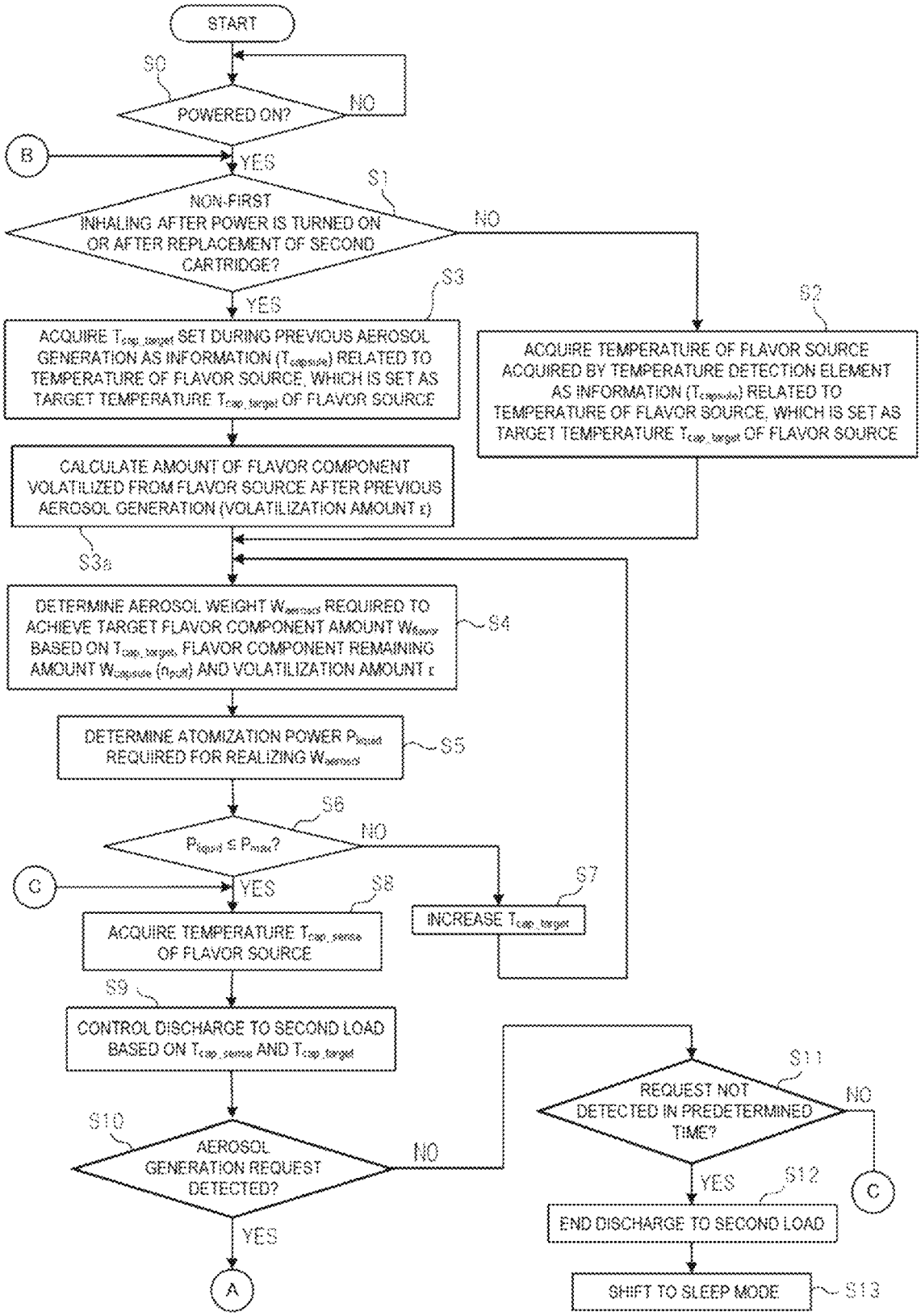
FIG. 9 is a flowchart for explaining the operation of the aerosol generation device in FIG. 1.
Figure 10:
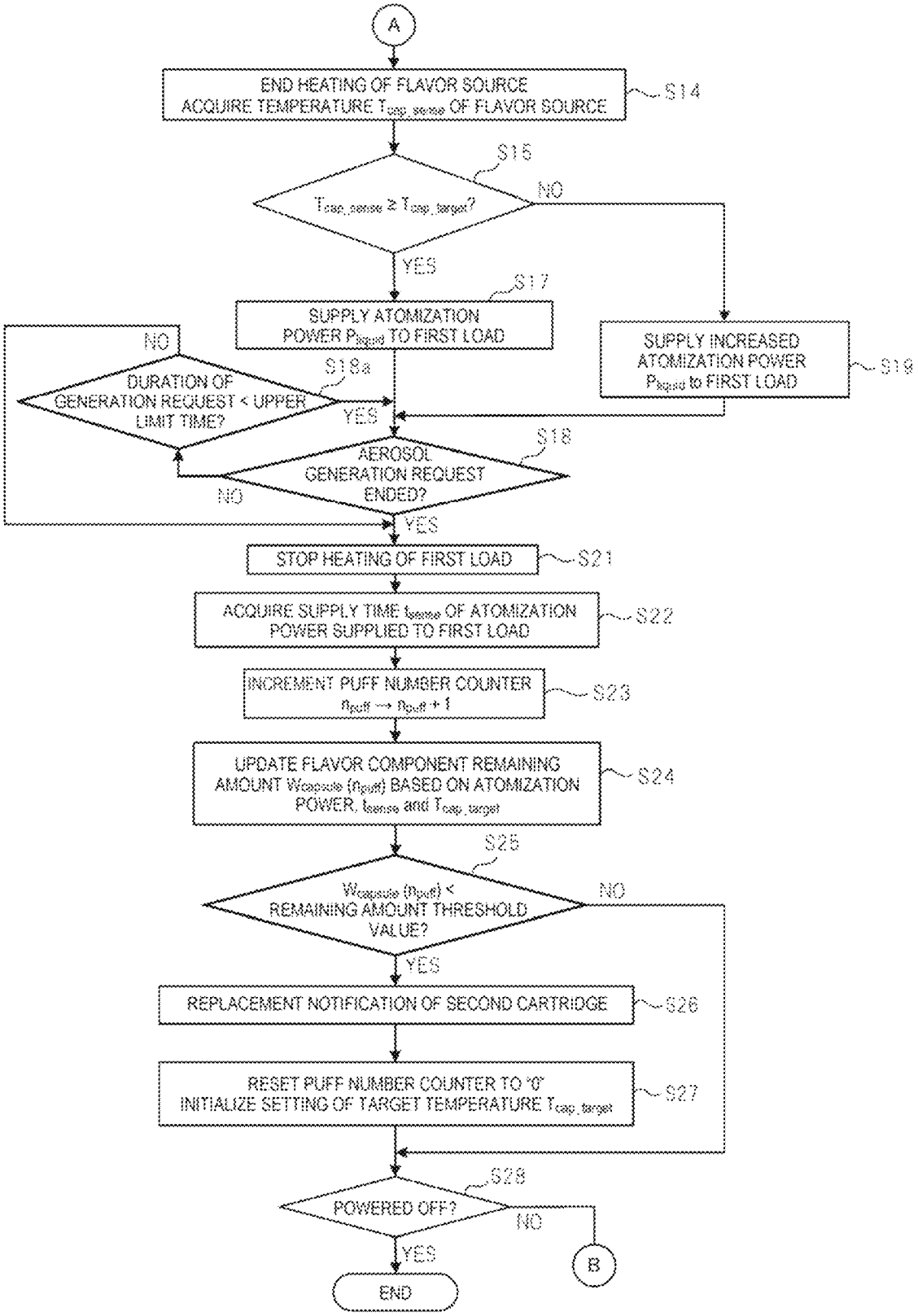
FIG. 10 is a flow chart for explaining the operation of the aerosol generation device in FIG. 1.

FIGS. 9 and 10 are flowcharts for explaining the operation of the aerosol generation device 1 in FIG. 1. When the aerosol generation device 1 is activated (powered ON) by an operation of the operation unit 14 or the like (step S0: YES), the MCU 50 determines whether an aerosol is generated (whether inhaling by the user is performed even once) after the power is turned ON or after the second cartridge 30 is replaced (step S1).

For example, the MCU 50 includes a built-in puff number counter that counts up $n_{puff}$ from an initial value (for example, 0) each time the inhaling (an aerosol generation request) is performed. A count value of the puff number counter is stored in the memory 50*a*. The MCU 50 determines whether the state is a state after the inhaling is performed even once with reference to the count value. When extremely short inhaling (for example, less than 0.1 seconds) or extremely weak inhaling (for example, 10 mL/second) is detected, the puff number counter does not have to count up. In other words, the puff number counter does not count up until sufficient inhaling is performed, and continues to hold the count value until the last sufficient inhaling is performed.

In a case of first inhaling after the power is turned ON or a timing before the first inhaling after the second cartridge 30 is replaced (step S1: NO), the flavor source 33 is not yet heated or heating is not yet performed for a while, and a temperature of the flavor source 33 is highly likely to depend on an external environment. Therefore, in this case, the MCU 50 acquires the temperature of the flavor source 33 acquired based on an output of the temperature detection element T1 (or the temperature detection element T3) as the capsule temperature parameter $T_{capsule}$, sets the acquired temperature of the flavor source 33 as the target temperature $T_{cap_target}$ of the flavor source 33, and stores the target temperature $T_{cap_target}$ in the memory 50*a* (step S2).

When the determination in step S1 is NO, the temperature of the flavor source 33 is highly likely to be close to an outside air temperature or a temperature of the power supply unit 10. Therefore, in step S2, as a modification, the outside air temperature or the temperature of the power supply unit 10 may be acquired as the capsule temperature parameter $T_{capsule}$, which may be set as the target temperature $T_{cap_target}$.

The outside air temperature is preferably acquired from, for example, a temperature sensor built in the intake sensor 15. The temperature of the power supply unit 10 is preferably acquired from, for example, a temperature sensor built in the MCU 50 in order to manage a temperature inside the MCU 50. In this case, both the temperature sensor built in the intake sensor 15 and the temperature sensor built in the MCU 50 function as elements that output information related to the temperature of the flavor source 33.

In the aerosol generation device 1, as described above, discharge from the power supply 12 to the second load 31 is controlled such that the temperature of the flavor source 33 converges to the target temperature $T_{cap_target}$. Therefore, after the inhaling is performed even once after the power is turned ON or the second cartridge 30 is replaced, the temperature of the flavor source 33 is highly likely to be close to the target temperature $T_{cap_target}$. Therefore, in this case (step S1: YES), the MCU 50 acquires the target temperature $T_{cap_target}$ stored in the memory 50*sa* and used for the previous aerosol generation as the capsule temperature parameter $T_{capsule}$, which is directly set as the target temperature $T_{cap_target}$ (step S3). In this case, the memory 50*a* functions as an element that outputs information related to the temperature of the flavor source 33.

In step S3, the MCU 50 may acquire the temperature of the flavor source 33 acquired based on the output of the temperature detection element T1 (or the temperature detection element T3) as the capsule temperature parameter $T_{capsule}$, and set the acquired temperature of the flavor source 33 as the target temperature $T_{cap_target}$ of the flavor source 33. In this way, the capsule temperature parameter $T_{capsule}$ can be acquired more accurately.

When the processing of step S3 is performed, the MCU 50 calculates an amount of the flavor component volatilized from the flavor source 33 after the previous aerosol generation (hereinafter, referred to as a volatilization amount ε) (step S3*a*). In the example of FIG. 7, the processing of step S3*a* is performed at a timing between the time t3 and the time t4.

In step S3*a*, the MCU 50 acquires, as a parameter P1, the elapsed time from the time t3, which is a timing at which the previous aerosol generation ends. The MCU 50 acquires, as a parameter P2, the flavor component remaining amount calculated as described later at a timing immediately after the time t3. The MCU 50 acquires, as a parameter P3, the target temperature of the flavor source 33 set at the time t3 or the temperature of the flavor source 33 (or the second load 31) at a time when the processing of step S3*a* is performed. The MCU 50 acquires, as a parameter P4, an accumulated value of an amount of power (atomization power×supply time) supplied to the first load 21 for aerosol generation after the second cartridge 30 is replaced with a new one. The parameter P4 is the accumulated value of the amount of power supplied to the first load 21 after the puff number counter reaches the initial value (=0). The MCU 50 acquires, as a parameter P5, the outside air temperature at the time t3 or at the time point when the processing of step S3*a* is performed. Each of the parameters P1 to P5 indicates that the volatilization amount s of the flavor component increases as a value thereof increases.

In the embodiment described above, the MCU 50 acquires, as the parameter P4, the accumulated value of the amount of power supplied to the first load 21 for the aerosol generation after the second cartridge 30 is replaced with the new one. Instead of the present embodiment, the MCU 50 may acquire, as the parameter P4, the accumulated value of the amount of power supplied to the first load 21 for the aerosol generation after causing at least one of the first notification unit 45 and the second notification unit 46 to perform a notification for prompting replacement of the second cartridge 30 in step S26 described later. In this way, since the MCU 50 does not need to detect the replacement of the second cartridge 30, a cost of the power supply unit 10 can be reduced.

In step S3*a*, the MCU 50 calculates the volatilization amount ε based on the parameters P1 to P5. For example, the volatilization amount ε is calculated by calculation of the following Equation (A). p1 to p5 in Equation (A) are experimentally determined coefficients.

$$\varepsilon = p1 \times P1 + p2 \times P2 + p3 \times P3 + p4 \times P4 + p \times P5 \quad \text{(A)}$$

The volatilization amount F may be calculated by omitting some of the parameters P1 to P5. That is, the volatilization amount ε may be calculated based on one, two, three or four parameters selected from the parameters P1 to P5. In this case, the volatilization amount ε may be calculated by deleting a term of the omitted parameter in Equation (A).

After step S2 or step S3*a*, the MCU 50 determines the aerosol weight $W_{aerosol}$ required to achieve the target flavor component amount $W_{flavor}$ by the calculation of Equation (4) based on the set target temperature $T_{cap_target}$, the flavor component remaining amount $W_{capsule}$ ($n_{puff}$) of the flavor source 33 at the present time point, and the volatilization amount ε (step S4). Equation (4) is obtained by modifying Equation (2) in which $W_{capsule}$ ($n_{puff}$) is $\{W_{capsule}(n_{puff})-\varepsilon\}$ and $T_{capsule}$ is $T_{cap_target}$. When the processing of step S4 is subsequently performed after the processing of step S2 is performed, the volatilization amount s is treated as "0". $\{W_{capsule}(n_{puff})-\varepsilon\}$ constitutes a second remaining amount.

$$W_{aerosol} = \frac{W_{flavor}}{\beta \times \{W_{capsule}(n_{puff}) - e\} \times T_{cap_target} \times \gamma} \quad (4)$$

Next, the MCU 50 determines the atomization power $P_{liquid}$ required for realizing the aerosol weight $W_{aerosol}$ determined in step S4 by the calculation of Equation (1) in which $t_{sense}$ is the upper limit time $t_{upper}$ (step S5).

A table in which a combination of the target temperature $T_{cap_target}$ and $\{W_{capsule}(n_{puff})-\varepsilon\}$ is associated with the atomization power $P_{liquid}$ may be stored in the memory 50*a* of the MCU 50, and the MCU 50 may determine the atomization power $P_{liquid}$ using the table. Thereby, the atomization power $P_{liquid}$ can be determined at high speed and low power consumption.

In the aerosol generation device 1, as will be described later, when the temperature of the flavor source 33 does not reach the target temperature at a time point when the aerosol generation request is detected, a shortage of the flavor component amount $W_{flavor}$ is compensated for by an increase in the aerosol weight $W_{aerosol}$ (an increase in the atomization power). In order to ensure the increase in the atomization power, the atomization power determined in step S5 needs to be set lower than the upper limit value $P_{upper}$ of the power that can be supplied to the first load 21 determined by a hardware configuration.

Specifically, after step S5, when the atomization power $P_{liquid}$ determined in step S5 exceeds a power threshold value $P_{max}$ lower than the upper limit value $P_{upper}$ (step S6: NO), the MCU 50 increases the target temperature $T_{cap_target}$ of the flavor source 33 (step S7), and returns the processing to step S4. As can be seen from Equation (4), by increasing the target temperature $T_{cap_target}$, the aerosol weight $W_{aerosol}$ required to achieve the target flavor component amount $W_{flavor}$ can be reduced. As a result, the atomization power $P_{liquid}$ determined in step S5 can be reduced. By repeating steps S4 to S7, the MCU 50 can set the determination in step S6, which was initially determined to be NO, to YES, and shift the processing to step S8.

When the atomization power $P_{liquid}$ determined in step S5 is equal to or smaller than the power threshold value $P_{max}$ (step S6: YES), the MCU 5 acquires a temperature $T_{cap_sense}$ of the flavor source 33 at the present time point based on the output of the temperature detection element T1 (or the temperature detection element T3)(step S8).

Then, the MCU 50 controls the discharge to the second load 31 for heating the second load 31 based on the temperature $T_{cap_sense}$ and the target temperature $T_{cap_target}$ (step S9). Specifically, the MCU 50 supplies the power to the second load 31 by proportional-integral-differential (PID) control or ON/OFF control such that the temperature $T_{cap_sense}$ converges to the target temperature $T_{cap_target}$.

In the PID control, a difference between the temperature $T_{cap_sense}$ and the target temperature $T_{cap_target}$ is fed back, and power control is performed based on the feedback result such that the temperature $T_{cap_sense}$ converges to the target temperature $T_{cap_target}$. According to the PID control, the temperature $T_{cap_sense}$ can converge to the target temperature $T_{cap_target}$ with high accuracy. The MCU 50 may use proportional (P) control or proportional-integral (PI) control instead of the PID control.

The ON/OFF control is control in which the power is supplied to the second load 31 in a state where the temperature $T_{cap_sense}$ is lower than the target temperature $T_{cap_target}$, and power supply to the second load 31 is stopped until the temperature $T_{cap_sense}$ becomes lower than the target temperature $T_{cap_target}$ in a state where the temperature $T_{cap_sense}$ is equal to or higher than the target temperature $T_{cap_target}$. According to the ON/OFF control, the temperature of the flavor source 33 can be increased faster than the PID control. Therefore, it is possible to increase a possibility that the temperature $T_{cap_sense}$ reaches the target temperature $T_{cap_target}$ before the aerosol generation request described later is detected. The target temperature $T_{cap_target}$ may have hysteresis.

After step S9, the MCU 50 determines whether there is an aerosol generation request (step S10). When the aerosol generation request is not detected (step S10: NO), the MCU 50 determines a length of time during which the aerosol generation request is not performed (hereinafter, referred to as non-operation time) in step S11. When the non-operation time reaches a predetermined time (step S11: YES), the MCU 50 ends the discharge to the second load 31 (step S12), and shifts to a sleep mode in which power consumption is reduced (step S13). When the non-operation time is less than the predetermined time (step S11: NO), the MCU 50 shifts the processing to step S8.

When the aerosol generation request is detected (step S10: YES), the MCU 50 ends the discharge to the second load 31, and acquires the temperature $T_{cap_sense}$ of the flavor source 33 at that time point based on the output of the temperature detection element T1 (or the temperature detection element T3) (step S14). Then, the MCU 50 determines whether the temperature $T_{cap_sense}$ acquired in step S14 is equal to or higher than the target temperature $T_{cap_target}$ (step S15).

When the temperature $T_{cap_sense}$ is lower than the target temperature $T_{cap_target}$ (step S15: NO), the MCU 50 increases the atomization power $P_{liquid}$ determined in step S5 in order to compensate for a decrease in the flavor component amount due to an insufficient temperature of the flavor source 33. Specifically, first, the MCU 50 supplies the atomization power $P_{liquid}$ obtained by adding a predetermined increase amount $\Delta P$ to the atomization power $P_{liquid}$ determined in step S5 to the first load 21 to start heating of the first load 21 (step S19).

In step S15, when the temperature $T_{cap_sense}$ is equal to or higher than the target temperature $T_{cap_target}$ (step S15: YES), the MCU 50 supplies the atomization power $P_{liquid}$ determined in step S5 to the first load 21 to start the heating of the first load 21, and generates the aerosol (step S17).

After the heating of the first load 21 is started in step S19 or step S17, when the aerosol generation request does not end (step S18: NO), and if duration of the aerosol generation request is shorter than the upper limit time $t_{upper}$ (step S18*a*: YES), the MCU 50 continues the heating of the first load 21. When the duration of the aerosol generation request reaches the upper limit time $t_{upper}$ (step S18*a*: NO) and when the aerosol generation request ends (step S18: YES), the MCU 50 stops the power supply to the first load 21 (step S21).

The MCU 50 may control the heating of the first load 21 in step S17 or step S19 based on an output of the temperature detection element T2. For example, if the MCU 50 executes the PID control or the ON/OFF control using a boiling point of the aerosol source 22 as the target temperature based on the output of the temperature detection element T2, overheating of the first load 21 and the aerosol source 22 can be prevented, and an amount of the aerosol source 22 atomized by the first load 21 can be highly controlled.

Figure 11:
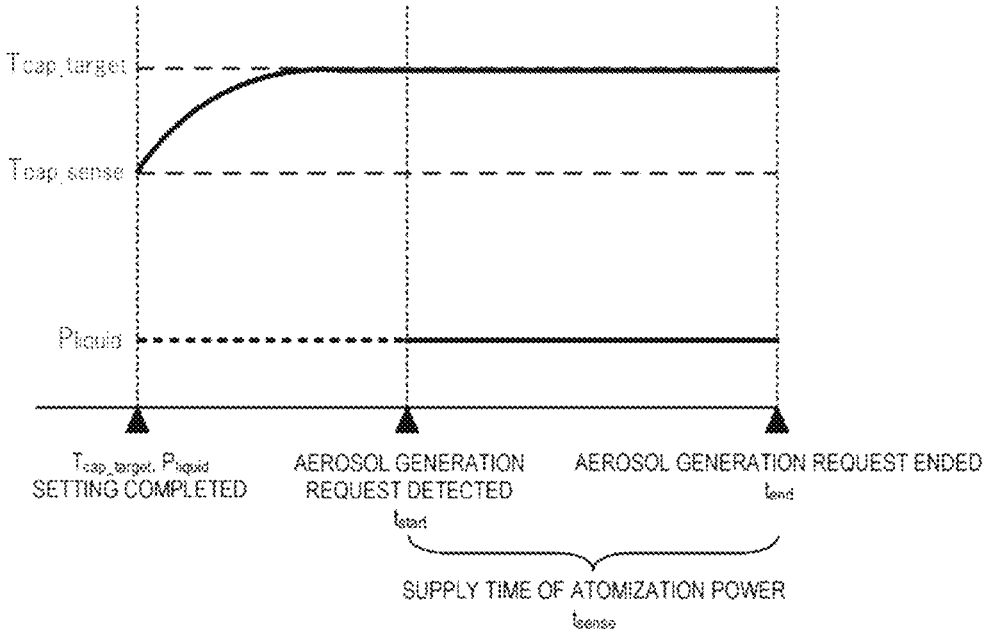
FIG. 11 is a schematic view showing atomization power supplied to a first load 21 in step S17 of FIG. 10.
Figure 12:
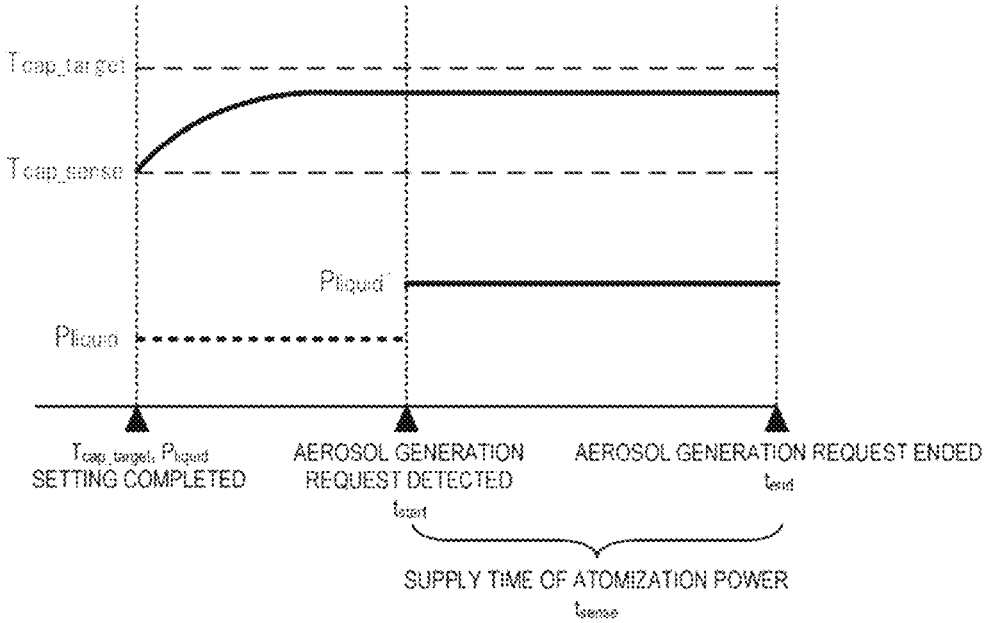
FIG. 12 is a schematic view showing the atomization power supplied to the first load 21 in step S19 of FIG. 10.

FIG. 11 is a schematic view showing the atomization power supplied to the first load 21 in step S17 of FIG. 10. FIG. 12 is a schematic view showing the atomization power supplied to the first load 21 in step S19 of FIG. 10. As shown in FIG. 12, when the temperature $T_{cap_sense}$ does not reach the target temperature $T_{cap_target}$ at a time point when the aerosol generation request is detected, the atomization power $P_{liquid}$ is increased and then supplied to the first load 21.

In this way, even when the temperature of the flavor source 33 does not reach the target temperature at a time point when the aerosol generation request is made, an amount of the aerosol to be generated can be increased by performing the processing of step S19. As a result, the decrease in the flavor component amount added to the aerosol due to the temperature of the flavor source 33 being lower than the target temperature can be compensated for by an increase in the amount of the aerosol. Therefore, the flavor component amount added to the aerosol can converge to a target amount.

On the other hand, when the temperature of the flavor source 33 reaches the target temperature at the time point when the generation request of the aerosol is made, a desired amount of the aerosol required to achieve the target flavor component amount is generated by the atomization power determined in step S5. Therefore, the flavor component amount added to the aerosol can converge to the target amount.

After step S21, the MCU 50 acquires the supply time $t_{sense}$ of the atomization power supplied to the first load 21 in step S17 or step S19 (step S22). When the MCU 50 detects the aerosol generation request beyond the upper limit time $t_{upper}$, the supply time $t_{sense}$ is equal to the upper limit time $t_{upper}$. Further, the MCU 50 increments the puff number counter by "1" (step S23).

The MCU 50 updates the flavor component remaining amount $W_{capsule}$ ($n_{puff}$) of the flavor source 33 based on the supply time $t_{sense}$ acquired in step S22, the atomization power supplied to the first load 21 in response to the aerosol generation request, and the target temperature $T_{cap_target}$ at the time point when the aerosol generation request is detected (step S24). The updated flavor component remaining amount $W_{capsule}$ ($n_{puff}$) constitutes a first remaining amount.

When the control shown in FIG. 11 is performed, the flavor component amount $W_{flavor}$ added to the aerosol generated from a start to an end of the aerosol generation request can be obtained by the following Equation (7). In Equation (7), ($t_{end}-t_{start}$) represents the supply time $t_{sense}$. The flavor component remaining amount $W_{capsule}$ ($n_{puff}$) in Equation (7) is a value at a time point immediately before the aerosol generation request is performed. The volatilization amount ε in Equation (7) is a value calculated in step S3*a* before the aerosol generation request is performed. When step S2 is performed instead of step S3, the flavor component amount $W_{flavor}$ is calculated by setting the volatilization amount Z in Equation (7) to "0".

$$W_{flavor}=\beta\times[\{W_{capsule}(n_{puff})-\varepsilon\}\times T_{cap_target}]\times\gamma\times\alpha\times P_{liquid}\times(t_{end}-t_{start}) \quad (7)$$

When the control shown in FIG. 12 is performed, the flavor component amount $W_{flavor}$ added to the aerosol generated from the start to the end of the aerosol generation request can be obtained by the following Equation (7A). In Equation (7A), ($t_{end}-t_{start}$) represents the supply time $t_{sense}$. The flavor component remaining amount $W_{capsule}$ ($n_{puff}$) in Equation (7A) is a value at the time point immediately before the aerosol generation request is performed. The volatilization amount ε in Equation (7A) is a value calculated in step S3*a* before the aerosol generation request is performed. When step S2 is performed instead of step S3*a*, the flavor component amount $W_{flavor}$ is calculated by setting the volatilization amount ε in Equation (7A) to "0".

$$W_{flavor}=\beta\times\{W_{capsule}(n_{puff})-\varepsilon\}\times T_{cap_target}]\times\gamma\times\alpha\times P_{liquid}'\times(t_{end}-t_{start}) \quad (7A)$$

The thus obtained $W_{flavor}$ for each aerosol generation request is stored in the memory 50*a*, and values of the past flavor component amounts $W_{flavor}$ including the flavor component amount $W_{flavor}$ at the time of the current aerosol generation and the flavor component amount $W_{flavor}$ at the time of the previous aerosol generation are substituted into Equation (3) (that is, a value obtained by multiplying an integrated value of the values of the past flavor component amounts $W_{flavor}$ by a coefficient δ is subtracted from $W_{initial}$), whereby the flavor component remaining amount $W_{capsule}$ ($n_{puff}$) after the aerosol generation can be derived with high accuracy and updated.

Next, the MCU 50 determines whether the updated flavor component remaining amount $W_{capsule}$ ($n_{puff}$) is smaller than a remaining amount threshold value (step S25). When the updated flavor component remaining amount $W_{capsule}$ ($n_{puff}$) is equal to or greater than the remaining amount threshold value (step S25: NO), the MCU 50 shifts the processing to step S28. When the updated flavor component remaining amount $W_{capsule}$ ($n_{puff}$) is smaller than the remaining amount threshold value (step S25: YES), the MCU 50 causes at least one of the first notification unit 45 and the second notification unit 46 to perform a notification for prompting replacement of the second cartridge 30 (step S26). Then, the MCU 50 resets the puff number counter to the initial value (=0), deletes the values of the past $W_{flavor}$ described above, and further initializes the target temperature $T_{cap_target}$ (step S27).

The initialization of the target temperature $T_{cap_target}$ means that the target temperature $T_{cap_target}$ at that time point stored in the memory 50*a* is excluded from a set value. As another example, when step S3 is always executed without step S1 and step S2, the initialization of the target temperature $T_{cap_target}$ means that the target temperature $T_{cap_target}$ at that time point stored in the memory 50*a* is set to a normal temperature or a room temperature.

After step S27, when the power is not turned off (step S28: NO), the MCU 50 returns the processing to step S1, and when the power is turned off (step S28: YES), the MCU 50 ends the processing. After step S26 and step S27, the MCU 50 may shift the processing to step S28 when detecting that the second cartridge 30 is attached/detached (the replacement of the second cartridge 30). The attachment and detachment of the second cartridge 30 may be detected by, for example, a dedicated sensor or the like provided in the power supply unit 10. Alternatively, the user may manually input from the operation unit 14 that the replacement is performed, and detection can be performed according to this input.

(Effects of Embodiment)

As described above, according to the aerosol generation device 1, each time the user inhales the aerosol, the discharge from the power supply 12 to the first load 21 and the second load 31 is controlled such that the flavor component amount contained in the aerosol converges to the target amount. Therefore, the flavor component amount provided to the user can be stabilized for each inhaling, and a commercial value of the aerosol generation device 1 can be increased. As compared with a case where the discharge is performed only on the first load 21, the flavor component amount for each inhaling provided to the user can be stabilized, and the commercial value of the aerosol generation device 1 can be further increased.

The aerosol generation device 1 corrects the flavor component remaining amount updated after the aerosol generation by the volatilization amount E that is an amount of the flavor component volatilized after the aerosol generation, and determines the atomization power to be supplied to the first load 21 at the time of the next aerosol generation based on the corrected flavor component remaining amount. Therefore, the discharge to the first load 21 and the second load 31 can be controlled based on a more accurate flavor component remaining amount in consideration of volatilization of the flavor component. Therefore, the flavor component amount for each inhaling provided to the user can be further stabilized, and the commercial value of the aerosol generation device 1 can be further increased.

(First Modification of Aerosol Generation Device)

Figure 13:
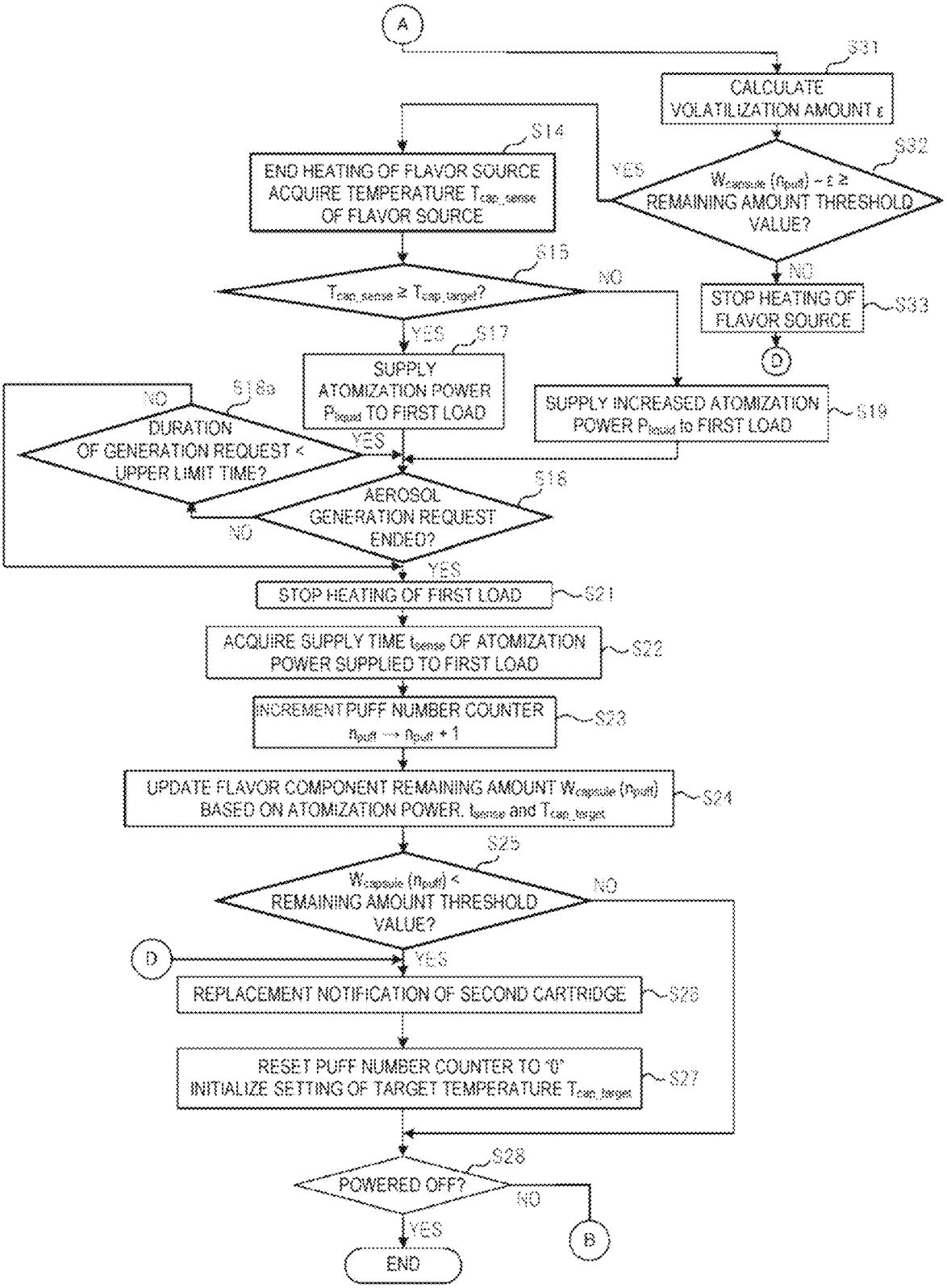
FIG. 13 is a flowchart for explaining a first modification of the operation of the aerosol generation device 1.

The operation after the determination in step S10 of FIG. 9 is YES (FIG. 10) may be modified as shown in FIG. 13. FIG. 13 is a flowchart for explaining a first modification of the operation of the aerosol generation device 1. FIG. 13 is the same as FIG. 10 except that steps S31 to S33 are added.

When the determination in step S10 of FIG. 9 becomes YES, the MCU 50 calculates the volatilization amount F at the present time point (step S31). The parameter P1 may change and the parameter P3 and the parameter P5 may change from a timing of the processing of step S3*a* to a timing of the processing of step S31 in FIG. 9. Therefore, in step S31, the MCU 50 acquires the parameters P1 to P5 and updates the volatilization amount ε based on the acquired parameters P1 to P5. When the determination in step S10 is YES after step S2 is performed instead of step S3*a*, the MCU 50 shifts the processing to step S14. That is, the processing of steps S31 to S33 is omitted.

After step S31, the MCU 50 determines whether a value obtained by subtracting the volatilization amount ε calculated in step S31 from the flavor component remaining amount $W_{capsule}$ ($n_{puff}$) is equal to or greater than a remaining amount threshold value (step S32). The remaining amount threshold value is the same as that used in step S25. When the determination in step S31 is YES, the MCU 50 shifts the processing to step S14, and when the determination in step S31 is NO, the MCU 50 shifts the processing to step S33.

In step S33, the MCU 50 stops the discharge to the second load 31. After step S33, the MCU 50 shifts the proceeding to step S26.

In this way, the volatilization amount ε is calculated when the aerosol generation request is made, and when the flavor component remaining amount considering the volatilization amount ε is insufficient, the replacement notification of the second cartridge 30 is performed. Thereby, the user can be notified of a shortage of the flavor source 33 at a timing when attention of the user is directed to the aerosol generation device 1 in order to perform the aerosol generation request. Therefore, it is easy to inform the user that the second cartridge 30 needs to be replaced.

(Second Modification of Aerosol Generation Device)

Figure 14:
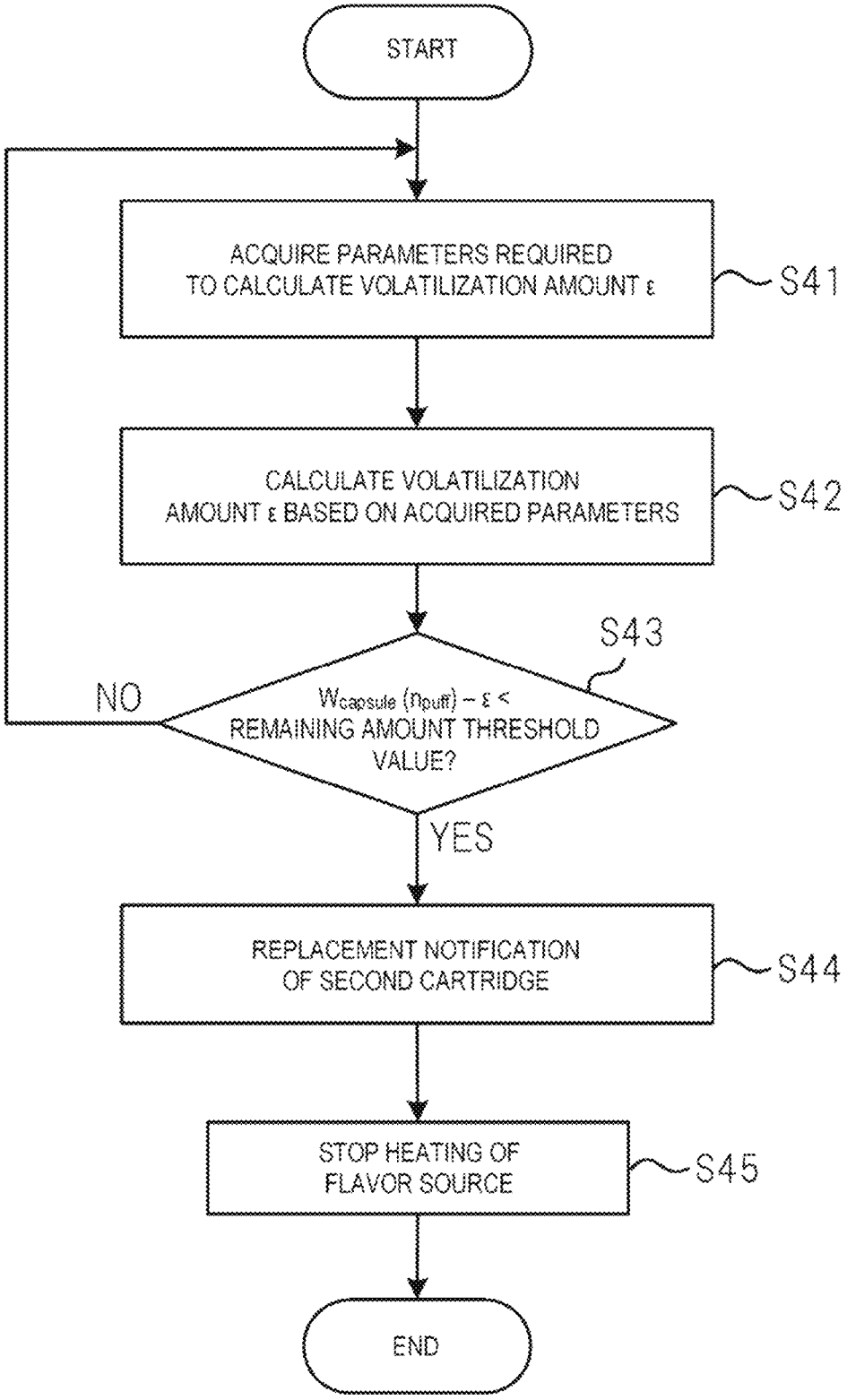
FIG. 14 is a flowchart for explaining a second modification of the operation of the aerosol generation device 1.

In the flowcharts shown in FIGS. 9 and 10, the MCU 50 may execute a subroutine shown in FIG. 14 during a period from a time point when the flavor component remaining amount is updated after the aerosol is generated to a time point when the next aerosol generation request is detected.

FIG. 14 is a flowchart for explaining a subroutine. The MCU 50 acquires the parameters P1 to P5 (step S41), and calculates the volatilization amount ε based on the acquired parameters P1 to P5 (step S42). The MCU 50 determines whether a value obtained by subtracting the volatilization amount ε calculated in step S42 from the flavor component remaining amount $W_{capsule}$ ($n_{puff}$) is equal to or greater than a remaining amount threshold value (step S43). The remaining amount threshold value is the same as that used in step S25. When the determination in step S43 is NO, the MCU 50 returns the processing to step S41. When the determination in step S43 is YES, the MCU 50 causes at least one of the first notification unit 45 and the second notification unit 46 to perform a notification for prompting replacement of the second cartridge 30 (step S44). Then, the MCU 50 resets the puff number counter to the initial value (=0), deletes the values of the past $W_{flavor}$, initializes the target temperature $T_{cap_target}$, and stops the discharge to the second load 31 (step S45). Step S44 and step S45 are interrupt processing for a main routine shown in FIGS. 9 and 10. That is, when step S44 and step S45 are executed, the MCU 50 stops the processing of the main routine shown in FIGS. 9 and 10 regardless of which step is being executed.

According to the second modification, regardless of presence or absence of the aerosol generation request, when the flavor component remaining amount considering the volatilization amount ε is insufficient, the replacement notification of the second cartridge 30 is immediately performed. In this way, when the user immediately knows a shortage of the remaining amount of the flavor source 33, inhaling is executed after the second cartridge 30 is replaced with a new one. Therefore, a situation in which the aerosol to which a flavor is added is not generated even when the inhaling is performed is prevented, and convenience of the aerosol generation device 1 is improved.

(Third Modification of Aerosol Generation Device)

Figure 15:
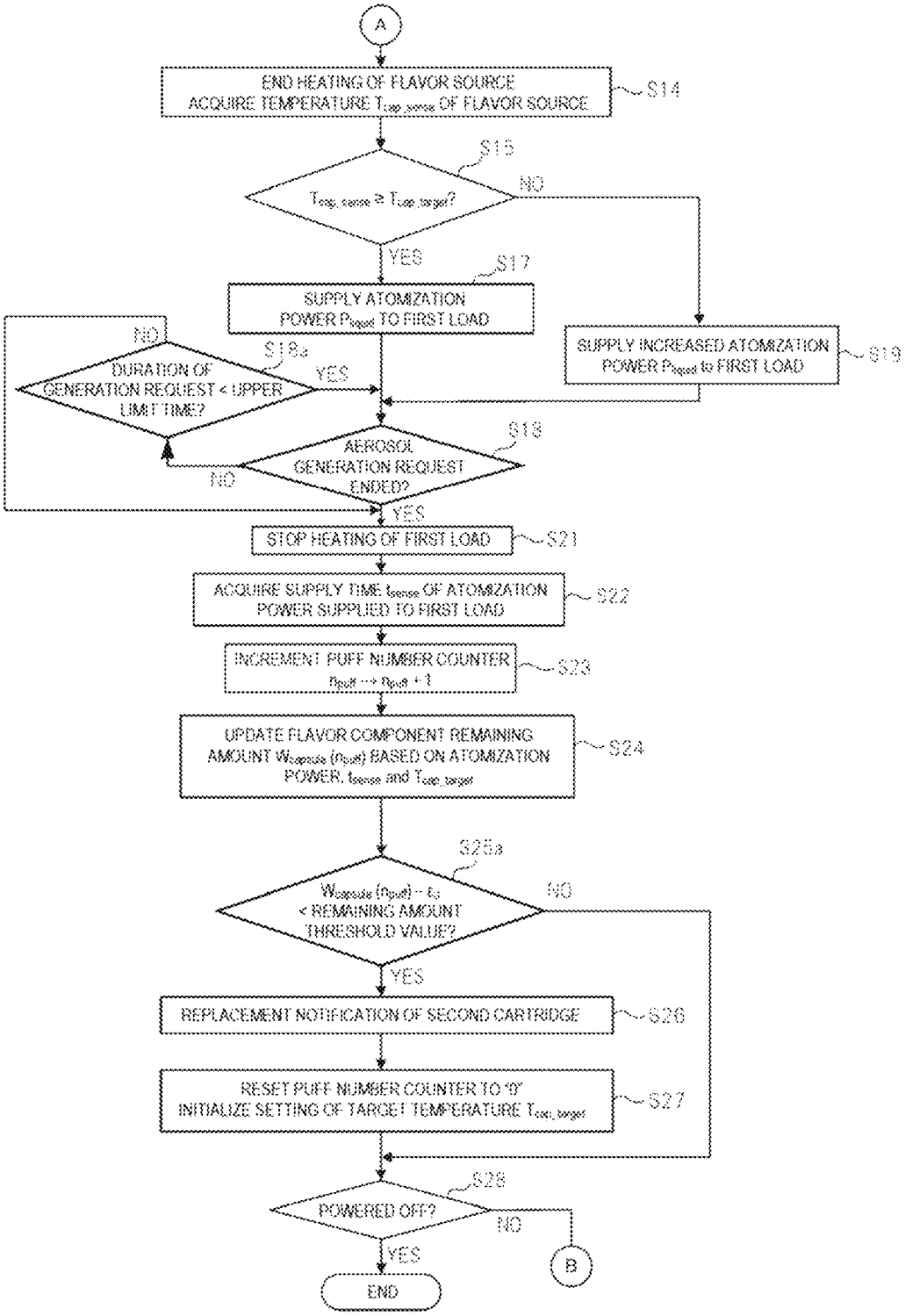
FIG. 15 is a flowchart for explaining a third modification of the operation of the aerosol generation device 1.

The operation after the determination in step S10 of FIG. 9 is YES (FIG. 10) may be modified as shown in FIG. 15. FIG. 15 is a flowchart for explaining a third modification of the operation of the aerosol generation device 1. FIG. 15 is the same as FIG. 10 except that step S25 is changed to step S25*a*.

When the flavor component remaining amount is updated in step S24, the MCU 50 determines whether a value obtained by subtracting a predetermined amount $\varepsilon_a$ determined in advance based on the updated flavor component remaining amount is smaller than a remaining amount threshold value (step S25*a*). The predetermined amount $\varepsilon_a$ is an amount of the flavor component assumed to volatilize until a start of the next aerosol generation, and is an experimentally determined fixed value. As the predetermined amount $\varepsilon_a$, for example, a value such as 1% or 0.5% of the flavor component remaining amount of the new second cartridge 30 is used. When the determination in step S25*a* is YES, the MCU 50 shifts the processing to step S26, and when the determination in step S25*a* is NO, the MCU 50 shifts the processing to step S28.

According to the third modification, in a case where the remaining amount of the flavor source 33 after the aerosol is generated is insufficient in consideration of subsequent volatilization, the notification is executed at a timing when attention of the user is directed to the aerosol generation device 1, that is, immediately after the aerosol is generated. Therefore, it is easy to inform a user that the second cartridge 30 needs to be replaced while preventing a situation in which the aerosol to which a flavor is added is not generated even when inhaling is performed.

In the aerosol generation device 1, the first load 21 may include elements that can atomize the aerosol source 22 without heating the aerosol source 22 by ultrasonic waves or the like. The elements that can be used for the first load 21 are not limited to a heater and an ultrasonic element, and various elements or combinations thereof can be used as long as the elements can atomize the aerosol source 22 by consuming the power supplied from the power supply 12.

At least the following matters are described in the present specification. The corresponding components and the like in the above-described embodiment are shown in parentheses, but the present invention is not limited thereto.

(1) A power supply unit for an aerosol generation device, the power supply unit comprising:

a power supply (power supply 12);

a first connector (discharging terminal 41) electrically connectable to an atomizer (first load 21) capable of atomizing an aerosol source (aerosol source 22) and electrically connected to the power supply;

a second connector (connector CN) electrically connectable to a heater (second load 31) capable of heating a flavor source (flavor source 33) that adds a flavor to an aerosol generated from the aerosol source, and electrically connected to the power supply; and a processing device (a processor of an MCU 50), wherein the processing device is configured to generate the aerosol to which the flavor is added by controlling discharge from the power supply to the atomizer and the heater, acquire a remaining amount of the flavor source at a first timing after generation of the aerosol to which the flavor is added as a first remaining amount (a flavor component remaining amount $W_{capsule}(n_{puff})$), and acquire a second remaining amount ($W_{capsule}(n_{puff})-\varepsilon$), which is a remaining amount of the flavor source at a timing between the first timing and a second timing when next generation of the aerosol to which the flavor is added starts, as an amount smaller than the first remaining amount.

According to (1), since the second remaining amount of the flavor source acquired during a period from after the generation of the aerosol to a start of the next generation of the aerosol is acquired as the amount smaller than the first remaining amount in consideration of volatilization of the flavor source after the generation of the aerosol, the remaining amount of the flavor source can be accurately acquired.

(2) The power supply unit according to (1), wherein the processing device is configured to control the discharge from the power supply to the atomizer and the heater based on the second remaining amount.

According to (2), since the discharge to the heater is controlled based on the accurate remaining amount of the flavor source in consideration of the volatilization, the aerosol to which the flavor is added can be generated while being highly controlled.

(3) The power supply unit according to (1) or (2), wherein the processing device is configured to acquire the second remaining amount based on an elapsed time from the first timing.

According to (3), since the second remaining amount is acquired based on the elapsed time closely related to an amount of the flavor source volatilized after the generation of the aerosol, the remaining amount of the flavor source after the volatilization can be accurately acquired.

(4) The power supply unit according to any one of (1) to (3), wherein the processing device is configured to acquire a temperature of the flavor source (temperature $T_{cap_sense}$), and acquire the second remaining amount based on the temperature of the flavor source at a timing after the first timing and before the second timing.

According to (4), since the second remaining amount is acquired based on the temperature of the flavor source closely related to the amount of the flavor source volatilized after the generation of the aerosol, the remaining amount of the flavor source after the volatilization can be accurately acquired.

(5) The power supply unit according to any one of (1) to (3), wherein the processing device is configured to acquire a temperature of the heater (temperature $T_{cap_sense}$), control the discharge from the power supply to the heater such that the temperature of the heater converges to any one of a plurality of target temperatures (target temperature $T_{cap_target}$), and acquire the second remaining amount based on a value of the temperature of the heater at the first timing or the one of target temperature.

According to (5), since the second remaining amount is acquired based on the temperature of the heater closely related to the amount of the flavor source volatilized after the generation of the aerosol or the target temperature, the remaining amount of the flavor source after the volatilization can be accurately acquired.

(6) The power supply unit according to anyone of (1) to (5), further comprising:

a notification unit (at least one of first notification unit 45 and second notification unit 46), wherein the processing device is configured to cause the notification unit to perform a notification when the remaining amount of the flavor source is smaller than a threshold value, and acquire the second remaining amount based on an accumulated value of an amount of power supplied to the atomizer after the notification.

According to (6), since the second remaining amount is acquired based on the accumulated amount of power supplied to the heater closely related to the amount of the flavor source volatilized after the generation of the aerosol, the remaining amount of the flavor source after the volatilization can be accurately acquired.

(7) The power supply unit device according to any one of (1) to (5), wherein the processing device is configured to detect attachment and detachment of a container (second cartridge 30) that accommodates the flavor source to and from the aerosol generation device, and acquire the second remaining amount based on an accumulated value of an amount of power supplied to the atomizer after the container is attached.

According to (7), since the second remaining amount is acquired based on the accumulated amount of power supplied to the heater closely related to the amount of the flavor source volatilized after the generation of the aerosol, the remaining amount of the flavor source after the volatilization can be accurately acquired.

(8) The power supply unit according to any one of (1) to (7), further comprising:

a sensor (temperature sensor built in intake sensor 15) that outputs a value related to an ambient temperature (outside air temperature) around the power supply unit, wherein the processing device is configured to acquire the second remaining amount based on an output of the sensor after the first timing and before the second timing.

According to (8), since the second remaining amount is acquired based on the ambient temperature closely related to the amount of the flavor source volatilized after the generation of the aerosol, the remaining amount of the flavor source at a timing after the volatilization can be accurately acquired.

(9) The power supply unit according to any one of (1) to (8), wherein the processing device is configured to acquire the second remaining amount based on the first remaining amount.

According to (9), since the second remaining amount is acquired based on the first remaining amount before the volatilization closely related to the amount of the flavor source volatilized after the generation of the aerosol, the remaining amount of the flavor source after the volatilization can be accurately acquired.

(10) The power supply unit according to any one of (1) to (9), further comprising:

the notification unit (at least one of first notification unit 45 and second notification unit 46), wherein the processing device is configured to cause the notification unit to immediately execute the notification when the second remaining amount is smaller than the threshold value.

According to (10), when the user immediately knows a shortage of the remaining amount of the flavor source due to the second remaining amount in consideration of the volatilization, inhaling is executed after the flavor source is replaced with a new one. Therefore, a situation in which the aerosol to which the flavor is added is not generated even when the inhaling is performed is prevented, and convenience of the aerosol generation device is improved.

(11) The power supply unit according to any one of (1) to (9), further comprising:

the notification unit (at least one of first notification unit 45 and second notification unit 46);

an input unit (intake sensor 15 or operation unit 14) capable of detecting an input by a user, wherein the processing device is configured to start the discharge from the power supply to the atomizer based on the input to the input unit, and cause the notification unit to execute the notification in response to the input to the input unit when the second remaining amount is smaller than the threshold value.

According to (11), when a shortage of the remaining amount of the flavor source due to the second remaining amount in consideration of the volatilization occurs, the notification is executed at a timing when attention of the user that the generation of the aerosol is required is directed to the aerosol generation device. For this reason, it is easy to inform the user that the flavor source needs to be replaced.

(12) The power supply unit according to (10) or (11), wherein the processing device is configured to immediately acquire an amount obtained by subtracting a predetermined amount (predetermined amount $\varepsilon_a$) from the first remaining amount after acquiring the first remaining amount, and cause the notification unit to immediately execute the notification when the amount obtained by subtracting the predetermined amount from the first remaining amount is smaller than the threshold value.

According to (12), in a case where the remaining amount of the flavor source after the generation of the aerosol is insufficient in consideration of subsequent volatilization, the notification is executed at a timing when attention of the user is directed to the aerosol generation device, that is, immediately after the generation of the aerosol. Therefore, it is easy to inform the user that the flavor source needs to be replaced while preventing the situation in which the aerosol to which the flavor is added is not generated even when the inhaling is performed.

What is claimed is:

1. A power supply unit for an aerosol generation device, the power supply unit comprising:

a power supply;

a first connector electrically connectable to an atomizer capable of atomizing an aerosol source and electrically connected to the power supply;

a second connector electrically connectable to a heater capable of heating a flavor source that adds a flavor to an aerosol generated from the aerosol source, and electrically connected to the power supply; and a processing device, wherein the processing device is configured to generate the aerosol to which the flavor is added by controlling discharge from the power supply to the atomizer and the heater, acquire a remaining amount of the flavor source at a first timing after generation of the aerosol to which the flavor is added as a first remaining amount, and acquire a second remaining amount, which is a remaining amount of the flavor source at a timing between the first timing and a second timing when next generation of the aerosol to which the flavor is added starts, as an amount smaller than the first remaining amount.

2. The power supply unit according to claim 1, wherein the processing device is configured to control the discharge from the power supply to the atomizer and the heater based on the second remaining amount.

3. The power supply unit according to claim 1, wherein the processing device is configured to acquire the second remaining amount based on an elapsed time from the first timing.

4. The power supply unit according to claim 1, wherein the processing device is configured to acquire a temperature of the flavor source, and acquire the second remaining amount based on the temperature of the flavor source at a timing after the first timing and before the second timing.

5. The power supply unit according to claim 1, wherein the processing device is configured to acquire a temperature of the heater, control the discharge from the power supply to the heater such that the temperature of the heater converges to any one of a plurality of target temperatures, and acquire the second remaining amount based on a value of the temperature of the heater at the first timing or a value of the one of target temperature.

6. The power supply unit according to claim 1, further comprising:

a notification unit, wherein the processing device is configured to cause the notification unit to perform a notification when the remaining amount of the flavor source is smaller than a threshold value, and acquire the second remaining amount based on an accumulated value of an amount of power supplied to the atomizer after the notification.

7. The power supply unit according to claim 1, wherein the processing device is configured to detect attachment and detachment of a container that accommodates the flavor source to and from the aerosol generation device, and acquire the second remaining amount based on an accumulated value of an amount of power supplied to the atomizer after the container is attached.

8. The power supply unit according to claim 1, further comprising:

a sensor that outputs a value related to an ambient temperature around the power supply unit, wherein the processing device is configured to acquire the second remaining amount based on an output of the sensor at a timing after the first timing and before the second timing.

9. The power supply unit according to claim 1, wherein the processing device is configured to acquire the second remaining amount based on the first remaining amount.

10. The power supply unit according to claim 1, further comprising:

the notification unit, wherein the processing device is configured to cause the notification unit to immediately execute the notification when the second remaining amount is smaller than the threshold value.

11. The power supply unit according to claim 1, further comprising:

the notification unit;

an input unit capable of detecting an input by a user, wherein the processing device is configured to start the discharge from the power supply to the atomizer based on the input to the input unit, and cause the notification unit to execute the notification in response to the input to the input unit when the second remaining amount is smaller than the threshold value.

12. The power supply unit for the aerosol generation device according to claim 10, wherein the processing device is configured to immediately acquire an amount obtained by subtracting a predetermined amount from the first remaining amount after acquiring the first remaining amount, and cause the notification unit to immediately execute the notification when the amount obtained by subtracting the predetermined amount from the first remaining amount is smaller than the threshold value.

* * * * *